US011937660B2

(12) United States Patent
Zeilinger et al.

(10) Patent No.: US 11,937,660 B2
(45) Date of Patent: Mar. 26, 2024

(54) HARD HAT FACE SHIELD ATTACHMENT SYSTEM

(71) Applicant: Milwaukee Electric Tool Corporation, Brookfield, WI (US)

(72) Inventors: Todd Andrew Zeilinger, Wauwatosa, WI (US); Nicole Z. Summersett, Milwaukee, WI (US); Christian R. Braun, Madison, WI (US); Samuel L. Lombardi, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 42 days.

(21) Appl. No.: 17/675,667

(22) Filed: Feb. 18, 2022

(65) Prior Publication Data

US 2022/0248797 A1 Aug. 11, 2022

Related U.S. Application Data

(63) Continuation of application No. PCT/US2022/015495, filed on Feb. 7, 2022.

(Continued)

(51) Int. Cl.
*A42B 3/22* (2006.01)

(52) U.S. Cl.
CPC ..... *A42B 3/223* (2013.01)

(58) Field of Classification Search
CPC ..... A42B 3/223; A42B 3/185; A42B 3/225
See application file for complete search history.

(56) References Cited

U.S. PATENT DOCUMENTS 1,860,690 A 5/1932 Rateau
2,631,286 A 3/1953 Bowers (Continued)

FOREIGN PATENT DOCUMENTS

CN 2689737 4/2005
CN 203341067 12/2013

(Continued)

OTHER PUBLICATIONS

Centurion Vision Plus ABS Helmet w/Integrated Retractable Visor/Safety Glasses. Lightweight Design with Ratchet Headband—Black, Date first available Aug. 13, 2019, [online]retrieved Feb. 9, 2022, available from https://www.amazon.com/Centurion-Integrated-Retractable-Glasses-Lightweight/dp/B07WSHNYJH?th=1 (Year: 2019).

(Continued)

*Primary Examiner* — Khaled Annis
(74) *Attorney, Agent, or Firm* — Reinhart Boerner Van Deuren s.c.

(57) ABSTRACT

Various face shield assemblies for hard hats are described. In one embodiment, the face shield assembly includes a hard hat, a mounting bracket, a face shield, a first pivot arm and a second pivot arm. The first pivot arm and second pivot arm are pivotally coupled to the hard hat and rotate with respect to the mounting bracket and the face shield. The face shield is coupled to the first pivot arm and the second pivot arm. The face shield actuates between stowed and operating positions such that the face shield can avoid objects near a front of the hard hat, such as a bill and/or lamp. In other embodiments the face shield assembly includes an adjustable frame coupled to the face shield and the hard hat. The adjustable frame rotates and/or slides with respect to the hard hat.

24 Claims, 35 Drawing Sheets

Related U.S. Application Data

(60) Provisional application No. 63/231,110, filed on Aug. 9, 2021, provisional application No. 63/185,717, filed on May 7, 2021, provisional application No. 63/146,931, filed on Feb. 8, 2021.

(56) References Cited

U.S. PATENT DOCUMENTS 2,728,913 A 1/1956 Connor
2,729,820 A * 1/1956 Anderson ..... A42B 3/225 2/9
2,798,222 A 7/1957 Evans et al.
2,801,420 A 8/1957 Malcolm, Jr.
3,419,907 A 1/1969 Zahn
3,685,054 A 8/1972 Raschke
4,028,743 A 6/1977 Christensen
4,097,929 A 7/1978 Lowe et al.
4,210,972 A 7/1980 Baclit
4,214,318 A 7/1980 Gomez
4,222,123 A 9/1980 Hellberg
4,224,694 A * 9/1980 Palmaer ..... A42B 3/166 2/8.1
4,316,289 A 2/1982 Hild
4,395,781 A 8/1983 Myers
4,422,184 A 12/1983 Myers
4,521,831 A 6/1985 Thayer
4,536,892 A 8/1985 Brinkhoff et al.
4,547,908 A 10/1985 Leif et al.
4,726,074 A 2/1988 Baclit et al.
4,752,974 A 6/1988 Haino
4,766,609 A 8/1988 Lane
4,793,007 A * 12/1988 Barnett ..... A42B 3/044 362/106
4,831,665 A 5/1989 Palmaer
4,985,933 A 1/1991 Lemoine
5,146,622 A 9/1992 Blutstein
5,226,189 A 7/1993 Blutstein
5,249,307 A 10/1993 Lemoine
5,357,635 A 10/1994 Lemoine
5,544,361 A 8/1996 Davidson et al.
5,752,280 A * 5/1998 Hill ..... A42B 3/185 351/155
6,009,555 A 1/2000 Siprut
6,173,447 B1 1/2001 Arnold
6,352,383 B1 3/2002 Ristola
6,497,493 B1 12/2002 Theisen
6,536,044 B2 3/2003 Watley
6,662,375 B2 12/2003 Lewis
6,766,534 B2 7/2004 Lewis et al.
6,782,556 B2 8/2004 Grilliot et al.
6,826,781 B2 12/2004 Lewis
6,832,393 B2 12/2004 Folkesson
6,892,393 B1 * 5/2005 Provost ..... G02C 3/02 2/10
6,959,989 B2 11/2005 Holm
7,007,306 B2 3/2006 Howard et al.
7,120,939 B1 10/2006 Howard et al.
7,908,668 B2 * 3/2011 Folkesson ..... A42B 3/185 2/6.3
8,225,419 B2 7/2012 Hersick et al.
8,225,421 B1 7/2012 Froissard
8,286,269 B2 * 10/2012 Springer ..... G02C 3/02 2/10
8,286,270 B2 * 10/2012 Higgins ..... A42B 3/185 2/6.3
8,291,513 B2 10/2012 Prinkey
8,434,167 B2 5/2013 Gleason et al.
8,539,613 B2 9/2013 Hersick et al.
8,555,424 B2 10/2013 Higgins
8,701,212 B2 4/2014 Daniels et al.
8,899,867 B2 12/2014 Tatomir
RE45,459 E 4/2015 Hersick et al.
9,004,801 B2 4/2015 Tatomir
9,049,896 B2 6/2015 Huh
9,380,822 B2 7/2016 Foster
9,408,429 B2 8/2016 Tatomir
9,408,430 B2 8/2016 Guay et al.
9,456,649 B2 10/2016 Basson
9,578,916 B2 2/2017 Daniels et al.
9,629,407 B2 4/2017 Foster
9,681,698 B2 6/2017 Tatomir
9,872,531 B2 1/2018 Wert et al.
9,885,471 B2 2/2018 Dirsa et al.
9,894,952 B2 2/2018 Hayes
10,136,693 B1 11/2018 Paulson
10,154,704 B1 12/2018 Caito, III
10,165,819 B2 1/2019 Klotz et al.
10,219,579 B2 3/2019 Gotti
10,448,693 B2 10/2019 Noordzij et al.
10,492,558 B2 12/2019 Pfanner et al.
10,506,839 B1 12/2019 Hanson et al.
10,512,295 B1 12/2019 Hanson et al.
10,645,987 B2 5/2020 Maldonado et al.
10,743,599 B2 8/2020 Silva et al.
10,765,894 B2 9/2020 Balk et al.
10,772,374 B2 9/2020 Shida
10,779,603 B2 9/2020 Persson et al.
10,912,344 B2 2/2021 Bohn et al.
10,935,811 B2 * 3/2021 Asemani ..... F16M 13/04
11,019,870 B2 6/2021 Hyma
11,064,755 B1 * 7/2021 Williams ..... A42B 3/0406
11,583,023 B2 * 2/2023 Jones ..... A42B 3/0406
11,617,408 B2 * 4/2023 Lu ..... A42B 3/221 2/424
2006/0109420 A1 5/2006 Holm
2008/0263754 A1 * 10/2008 Folkesson ..... A61F 9/025 2/426
2009/0013439 A1 * 1/2009 Thoman ..... A42B 3/185 2/446
2009/0031485 A1 2/2009 Prusinski et al.
2009/0038056 A1 2/2009 Dirsa et al.
2009/0094720 A1 * 4/2009 Stachler ..... A42B 3/185 2/5
2009/0235437 A1 * 9/2009 Springer ..... G02C 3/02 2/10
2009/0307816 A1 * 12/2009 Stachler ..... A42B 3/185 2/10
2009/0313745 A1 * 12/2009 Kang ..... A42B 3/225 2/424
2010/0011488 A1 1/2010 Sutton
2010/0223707 A1 * 9/2010 Moyses ..... A42B 3/225 2/8.2
2010/0223714 A1 * 9/2010 Stachler ..... A42B 3/185 2/431
2012/0246807 A1 * 10/2012 Klotz ..... A42B 3/225 2/243.1
2013/0031693 A1 2/2013 Gleason et al.
2014/0189942 A1 7/2014 Coombs
2015/0057621 A1 2/2015 Coombs
2015/0201696 A1 7/2015 Pfanner
2015/0335093 A1 11/2015 Curci et al.
2016/0066643 A1 3/2016 Squair
2016/0331059 A1 11/2016 Basson et al.
2016/0360820 A1 12/2016 Sommers
2017/0042274 A1 2/2017 Tatomir
2017/0049176 A1 2/2017 Giroux Bernier et al.
2017/0079364 A1 3/2017 Paulson
2017/0112224 A1 4/2017 Gotti
2017/0127745 A1 5/2017 Daniels et al.
2017/0231311 A1 * 8/2017 Chen ..... F21V 21/14 24/3.1
2017/0251748 A1 9/2017 Imppola
2017/0325534 A1 * 11/2017 Noordzij ..... A42B 3/223
2018/0242677 A1 8/2018 Pilenga
2018/0242678 A1 8/2018 Sommers
2018/0303072 A1 10/2018 Grebennikov
2018/0303190 A1 10/2018 Calilung et al.
2019/0001214 A1 1/2019 Burke
2019/0075882 A1 3/2019 Caito, III
2019/0082765 A1 3/2019 Manning et al.
2019/0104800 A1 4/2019 Schuster et al.
2019/0223537 A1 7/2019 Pfanner

(56) References Cited

U.S. PATENT DOCUMENTS

| | | | | |
|---|---|---|---|---|
| 2019/0231016 | A1 | 8/2019 | Deshpande et al. | |
| 2019/0350291 | A1 | 11/2019 | Maldonado et al. | |
| 2019/0380421 | A1 | 12/2019 | Noordzij et al. | |
| 2019/0391384 | A1* | 12/2019 | Rushmere | G02B 25/002 |
| 2020/0154811 | A1 | 5/2020 | Hyma | |
| 2020/0163396 | A1* | 5/2020 | Kang | A42B 3/221 |
| 2020/0170329 | A1 | 6/2020 | Bohn et al. | |
| 2020/0329806 | A1 | 10/2020 | Wong | |
| 2020/0383417 | A1* | 12/2020 | Bohn | A42B 3/225 |
| 2021/0000211 | A1 | 1/2021 | Persson et al. | |
| 2021/0137202 | A1* | 5/2021 | Greene | G02C 3/02 |
| 2021/0191149 | A1* | 6/2021 | Repko | A42B 1/247 |
| 2022/0248797 | A1* | 8/2022 | Zeilinger | A42B 3/185 |
| 2022/0346487 | A1* | 11/2022 | Whitesell | A42B 3/225 |
| 2022/0361620 | A1* | 11/2022 | Lu | A42B 3/221 |

FOREIGN PATENT DOCUMENTS

| | | | | |
|---|---|---|---|---|
| CN | 206724092 | | 12/2017 | |
| CN | 108730931 | | 1/2018 | |
| CN | 211241881 | | 8/2020 | |
| DE | 2030546 | | 3/1974 | |
| DE | 7728179 | | 1/1978 | |
| DE | 8333228 | | 3/1984 | |
| DE | 3730202 | | 4/1989 | |
| DE | 202016105678 | | 3/2017 | |
| DE | 202019001099 | | 7/2019 | |
| DE | 202020102502 | | 8/2020 | |
| EP | 0668029 | | 8/1995 | |
| EP | 0572760 | | 9/1998 | |
| EP | 2292112 | | 11/2011 | |
| EP | 2484318 | | 5/2014 | |
| GB | 2576752 | A * | 3/2020 | A42B 3/06 |
| KR | 10-1064120 | | 9/2011 | |
| WO | WO0070978 | | 11/2000 | |
| WO | WO01-13749 | | 3/2001 | |
| WO | WO08134905 | | 11/2008 | |
| WO | WO12006653 | | 1/2012 | |
| WO | WO13110675 | | 8/2013 | |
| WO | WO14016264 | | 1/2014 | |
| WO | WO14052009 | | 4/2014 | |
| WO | WO17009752 | | 1/2017 | |
| WO | WO17123116 | | 7/2017 | |
| WO | WO17167689 | | 10/2017 | |
| WO | WO18154507 | | 8/2018 | |
| WO | WO19040988 | | 3/2019 | |

OTHER PUBLICATIONS

Stihl Hard Hat Advance X-Vent Helmet, Date first available Apr. 10, 2019, [online]retrieved Feb. 9, 2022, available from https://www.amazon.com/gp/product/B07PNDZ137/ref=ppx_od_dt_b_asin_title_s00?ie=UTF8&psc=1 (Year: 2019).

International Search Report and Written Opinion for International Application No. PCT/US2022/015495, dated Jun. 2, 2022, 12 pages.

* cited by examiner

HARD HAT FACE SHIELD ATTACHMENT SYSTEM

CROSS-REFERENCE TO RELATED PATENT APPLICATIONS

The present application is a continuation of International Application No. PCT/US2022/015495, filed Feb. 7, 2022, which claims the benefit of and priority to U.S. Provisional Application No. 63/185,717, filed on May 7, 2021, U.S. Provisional Application No. 63/146,931, filed on Feb. 8, 2021, and U.S. Provisional Application No. 63/231,110, filed on Aug. 9, 2021, each of which is incorporated herein by reference in its entirety.

BACKGROUND OF THE INVENTION

The present invention relates generally to the field of hard hats. The present invention relates specifically to a hard hat face shield attachment system. Hard hat use in high-risk environments for head injury may provide added protection. A face shield provides further protection to a face of the user wearing the hard hat.

SUMMARY OF THE INVENTION

One embodiment of the invention relates to a hard hat system including a hard hat, a brim guard, and a locking mechanism. The hard hat includes a hard hat including a shell formed from a rigid material. The shell includes an external surface and an internal surface that defines a cavity sized to receive the head of a wearer. The brim guard is detachably coupled to a hard hat such that a front of the brim guard is positioned at a front of the hard hat. The brim guard includes a visor that extends radially outward from a center of the hard hat. The locking mechanism is coupled to the brim guard and is configured to actuate between a locked position and an unlocked position. The locking mechanism prevents the brim guard from sliding vertically with respect to the hard hat when the locking mechanism is in the locked position.

Another embodiment of the invention relates to a hard hat system including a hard hat, a first arm pivotally coupled to the hard hat, a second arm pivotally coupled to the first arm, and a face shield pivotally coupled to the second arm. The hard hat includes a shell formed from a rigid material, the shell includes an external surface and an internal surface that defines a cavity sized to receive the head of a wearer. The first arm rotates with respect to the hard hat around a first axis, and the second arm rotates with respect to the first arm around a second axis distinct from the first axis. The face shield rotates with respect to the second arm around a third axis. The face shield actuates between an operating position and a stowed position such that the face shield is positioned in front of the face of the wearer when the face shield is in the operating position, and the face shield is positioned above a front portion of the external surface of the shell when the face shield is in the stowed position.

Another embodiment of the invention relates to a face shield assembly. The face shield assembly includes a mounting bracket configured to be detachably coupled to a hard hat, a first arm pivotally coupled to the mounting bracket, the first arm rotates with respect to the mounting bracket around a first axis, a second arm pivotally coupled to the mounting bracket, the second arm rotates with respect to the mounting bracket around the first axis, and a face shield. The face shield is coupled to each of the first arm and the second arm.

The face shield actuates between an operating position and a stowed position. The face shield is positioned in front of the face of a wearer when the face shield is in the operating position, and the face shield is positioned above a front portion of the hard hat when the face shield is in the stowed position.

Another embodiment of the invention relates to a hard hat system including a hard hat and a face shield assembly. The hard hat includes a shell formed from a rigid material. The hard hat includes an external surface and an internal surface that defines a cavity sized to receive the head of a wearer. The face shield assembly includes a first arm pivotal relative to the hard hat, a second arm pivotal relative to the first arm, and a face shield pivotal with relative to the second arm. The first arm pivotally rotates with respect to the hard hat around a first axis. The second arm pivotally rotates with respect to the first arm around a second axis. The face shield pivots with respect to the second arm around a third axis. The face shield actuates between an operating position and a stowed position such that the face shield is positioned in front of the face of the wearer when the face shield is in the operating position, and the face shield is positioned above a front portion of the external surface of the hard hat when the face shield is in the stowed position.

In a specific embodiment, the hard hat system includes a plurality of first arms that rotates with respect to the hard hat, and second arms that rotate with respect to one of the plurality of first arms. In a specific embodiment, the second arm includes a concave portion that curves towards the first axis when the face shield is in the operating position. In a specific embodiment, the hard hat includes two ribs that extend circumferentially away from each other, and the arm is coupled to the two ribs.

Another embodiment of the invention relates to a hard hat system including a hard hat, an adjustable frame, and a face shield. The hard hat includes a shell formed from a rigid material. The hard hat includes an external surface and an internal surface that defines a cavity sized to receive the head of a wearer. The adjustable frame is slideably and pivotally coupled to the hard hat. The face shield is coupled to the adjustable frame. The face shield actuates between an operating position and a stowed position such that the face shield is positioned in front of the head of the wearer when the face shield is in the operating position, and the face shield is positioned above a front portion of the external surface of the hard hat when the face shield is in the stowed position.

In a specific embodiment, the hard hat system includes a mounting bracket fixedly coupled to the hard hat, and the movable frame is indirectly coupled to hard hat via being directly, slideably and pivotally coupled to the mounting bracket.

In a specific embodiment, the hard hat includes two ribs that protrude from the hard hat. The two ribs extend circumferentially away from each other, and a mounting bracket is coupled to the two ribs such that at least a portion of the two ribs extends upwardly away from the mounting bracket.

In a specific embodiment, the adjustable frame includes two arms that extend rearward from a front portion of the adjustable frame. Each of the two arms includes a first protrusion and a second protrusion that extend inwardly. The mounting bracket includes two slots on opposing sides of the mounting bracket, and each of the two slots receives a first protrusion and a second protrusion.

In a specific embodiment, the slot includes an upper portion and a lower portion. When the face shield is in the stowed position, each of the first protrusions are located within the upper portion of the respective slot and the each of the second protrusions are located within the lower portion of the respective slot. When the face shield is in the operating position, each of the first protrusions and each of the second protrusions are located within the lower portion of the respective slot.

Another embodiment of the invention relates to a face shield assembly configured to couple to a hard hat. The face shield assembly includes a mounting bracket configured to couple to a hard hat, an arm pivotally coupled to the mounting bracket at a first end of the arm, and a face shield. The arm pivots with respect to the mounting bracket around a first axis. The face shield is pivotally coupled to an opposing second end of the arm. The face shield pivots with respect to the arm around a second axis. The face shield actuates between an operating position and a stowed position such that the face shield is positioned in front of the head of the wearer when the face shield is in the operating position, and the face shield is positioned above a front portion of the external surface of the hard hat when the face shield is in the stowed position.

Another embodiment of the invention relates to a face shield assembly including a mounting bracket, a first arm, a second arm, a frame, and a face shield. The mounting bracket is configured to couple to a hard hat. The first arm is pivotally coupled to the mounting bracket, and the first arm pivotally rotates with respect to the mounting bracket around a first axis. The second arm is pivotally coupled to the mounting bracket, and the second arm pivotally rotates with respect to the mounting bracket around the first axis. The frame is pivotally coupled to each of the first arm and the second arm. The frame pivotally rotates with respect to each of the first arm and the second arm about a second axis. The face shield is coupled to the frame and actuates between an operating position and a stowed position. The face shield is positioned in front of the face of the wearer when the face shield is in the operating position, and the face shield is positioned above a front upper portion of the head of the wearer when the face shield is in the stowed position. In a specific embodiment, the first axis is distinct from the second axis.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a hard hat face shield attachment system are shown. Hard hats are used in a variety of construction jobs or other construction, residential, or commercial situations. In conventional face shield attachment systems, an operator can pivot the face shield away from the front of the face of the user. However, pivoting the face shield in this way can interfere with a brim of the hard hat and/or an accessory coupled to a front of the hard hat, e.g., a lamp.

In contrast, the hard hat systems discussed herein utilize an attachment structure that slides/translates (e.g., substantially linear motion) the face shield away from the face of a user and pivots the face shield up. The sliding and pivoting of the face shield avoids interference with the brim of the hard hat and/or an accessory attached to the hard hat.

Figure 1:
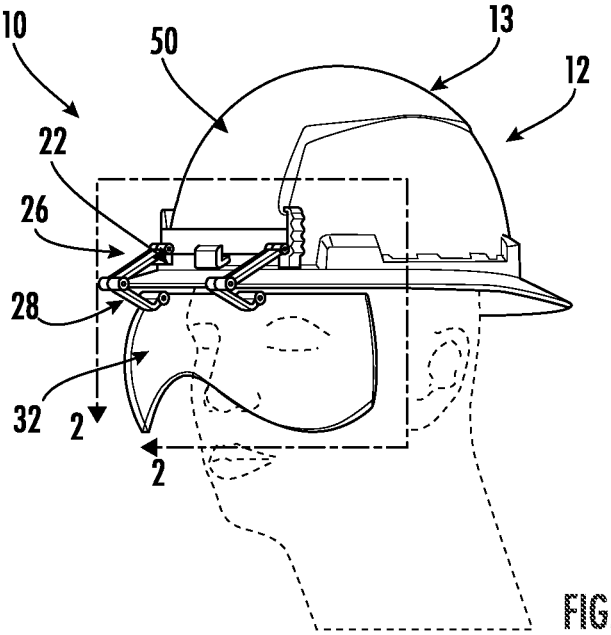
FIG. 1 is a perspective view of a hard hat system including a face shield, according to an exemplary embodiment.

Referring to FIGS. 1-9, a hard hat face shield system, shown as face shield assembly 10, is shown for hard hat 12. Referring to FIG. 1, an operator is shown wearing hard hat 12. As illustrated, hard hat 12 is oriented in a forward-facing direction with a bill 22 at the front end 50 of hard hat 12. Hard hat 12 includes an outer shell 13 formed from a rigid material, such as a rigid polymer material. Hard hat 12, such as shell 13 of hard hat 12, includes an external surface 16 and an opposing internal surface 18 that defines a cavity 20 of hard hat 12 sized to receive the head of a wearer.

One or more first arms 26 are pivotally coupled to hard hat 12. First arms 26 pivotally rotate with respect to hard hat 12 around a first axis 24. In a specific embodiment, mounting bracket 52 is detachably coupled to ribs 40 of hard hat 12, and first arm 26 is indirectly coupled to hard hat 12 via being directly and pivotally coupled to mounting bracket 52. Stated another way, the first arm 26 is pivotally coupled to the mounting bracket 52 such that the first arm 26 is coupled to the hard hat 12 via the mounting bracket 52. In a specific embodiment, ribs 40 of hard hat 12 extend circumferentially away from each other. In various embodiments, mounting bracket 52 is detachably coupled to ribs 40. In a specific embodiment, mounting bracket 52 couples to a mount and/or aperture at a front end 50 of hard hat 12.

Figure 2:
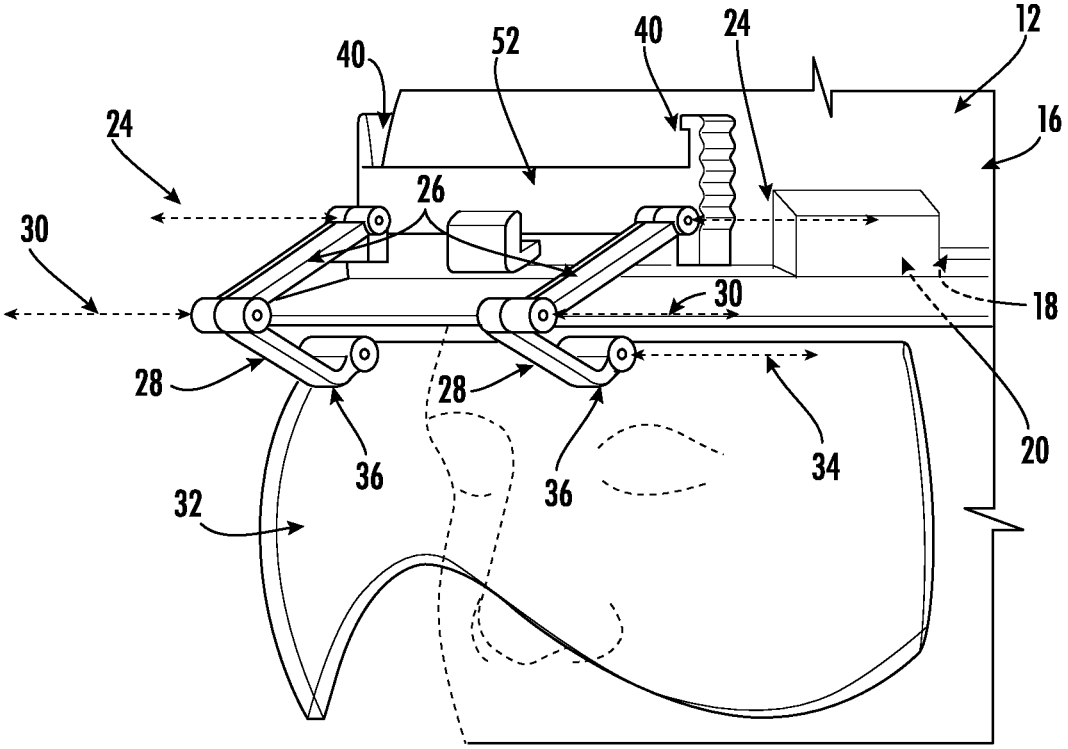
FIG. 2 is a detailed perspective view of the hard hat system of FIG. 1, according to an exemplary embodiment.

A second arm 28 is pivotally coupled to each of first arm(s) 26. The second arm 28 pivotally rotates with respect to first arm 26 around a second axis 30 distinct from the first axis 34 (e.g., not aligned with the first axis 34). In a specific embodiment, two first arms 26 are pivotally coupled to hard hat 12, two second arms 28 are coupled to the two first arms 26, and face shield 32 is pivotally coupled to the two second arms 28 (FIG. 2). In various embodiments, second arms 28 are coupled to a central portion of face shield 32. For example, second arms 28 are coupled to face shield 32 within 25% of the center of face shield 32 as measured along the lateral and longitudinal axis of face shield 32.

Figure 5:
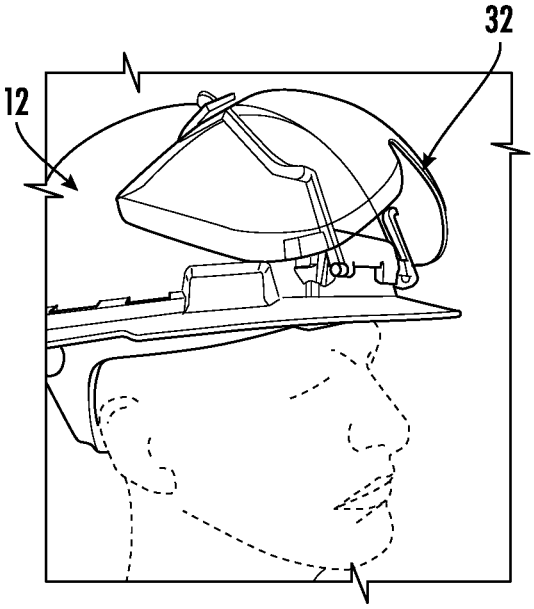
FIG. 5 is a perspective view of the hard hat system of FIG. 1, according to an exemplary embodiment.

Face shield 32 is pivotally coupled to second arm(s) 28. Face shield 32 actuates between an operating/lowered position (FIG. 3) and a stowed/raised position (FIG. 5). When the face shield 32 is in the operating position (FIG. 3), the face shield 32 is positioned in front of the face of the wearer, such as below the brim guard. When the face shield 32 is in the stowed position (FIG. 5), the face shield 32 is positioned above a front end 50 of the hard hat 12, such as above a brim guard. In various embodiments, when the face shield 32 is configured in the operating position on the head of the wearer, the face shield 32 covers the eyes of the wearer but does cover not the mouth of the wearer (FIG. 1). In a specific embodiment, second arm 28 includes a concave portion 36 that curves to the first axis 24 when the face shield 32 is in the operating position (FIG. 2). Stated another way, concave portion 36 is concave with respect to the head of the wearer when the face shield 32 is configured in the operating position. The face shield 32 pivotally rotates with respect to second arm 28 around a third axis 34. In various embodiments, third axis 34 is distinct from first axis 34 and second axis 30.

In various embodiments, two sets of first and second arms couple the face shield 32 to the hard hat 12 (FIG. 1). Stated another way, a first arm 26 and second arm 28 couple the face shield 32 to the hard hat 12 and a third and fourth arm (e.g., another first arm 26 and second arm 28) also couple the face shield 32 to the hard hat 12.

Figure 3:
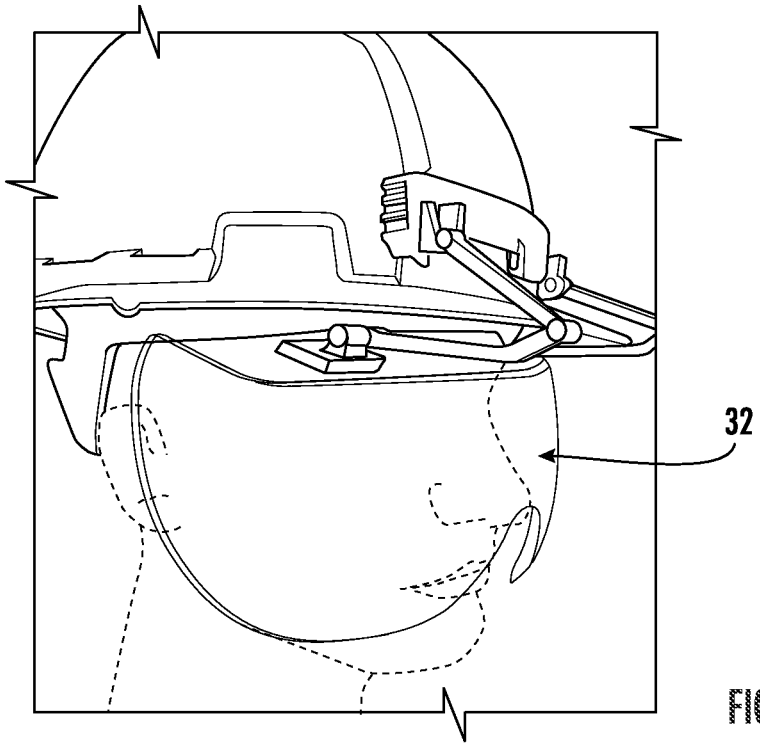
FIG. 3 is a perspective view of the hard hat system of FIG. 1, according to an exemplary embodiment.
Figure 4:
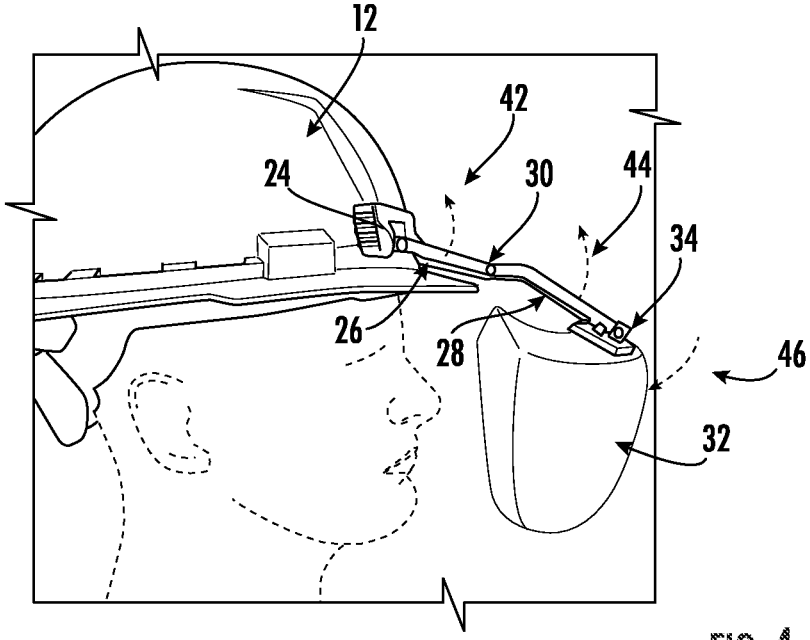
FIG. 4 is a side view of the hard hat system of FIG. 1, according to an exemplary embodiment.

Referring to FIGS. 3-5, an exemplary method of actuating face shield 32 from an operating position (FIG. 3) to a stowed position (FIG. 5) is shown. To rotate face shield 32 from the operating position, the operator pivots one or more of face shield 32, second arm 28, and/or first arm 26. The operator rotates face shield 32 in direction 46 with respect to second arm 28 around third axis 34, the operator rotates second arm 28 in direction 44 with respect to first arm 26 around second axis 30, and the operator rotates first arm 26 in direction 42 with respect to hard hat 12 around first axis 24. The operator continues rotating first arm 26, second arm 28, and/or face shield 32 until the face shield 32 is in the stowed position (FIG. 5).

Figure 6:
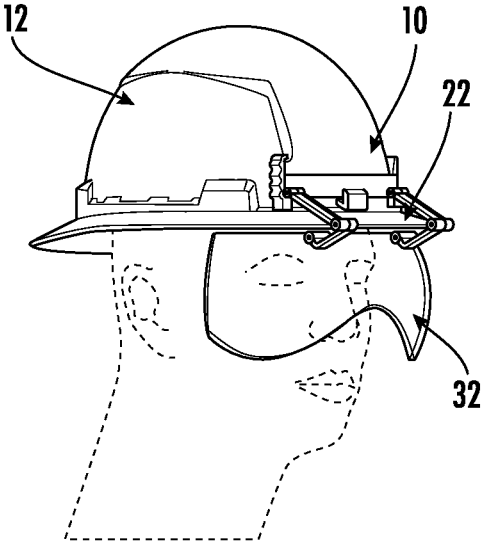
FIG. 6 is a perspective view of the hard hat system of FIG. 1, according to an exemplary embodiment.
Figure 7:
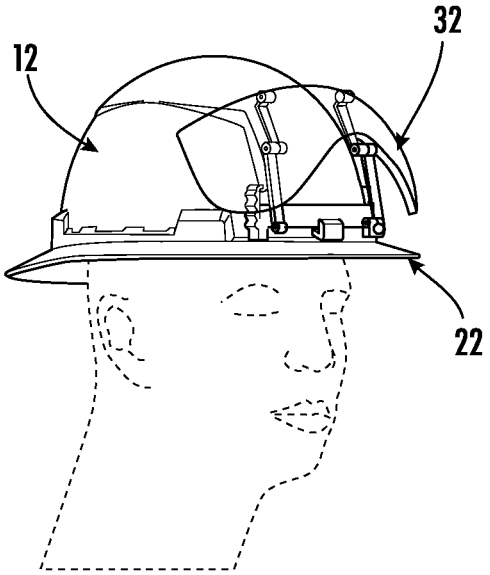
FIG. 7 is a perspective view of the hard hat system of FIG. 1, according to an exemplary embodiment.

Referring to FIGS. 6 and 7, various aspects of face shield 32 operating in cooperation with hard hat 12 including bill 22 are shown. Referring to FIG. 6, when face shield 32 is in the operating position, the arms reach out and around bill 22.

Figure 8:
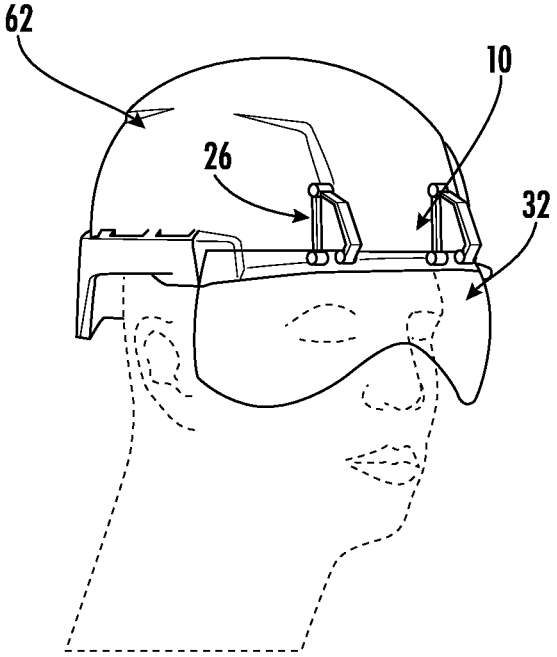
FIG. 8 is a perspective view of a hard hat system including a face shield, according to an exemplary embodiment.
Figure 9:
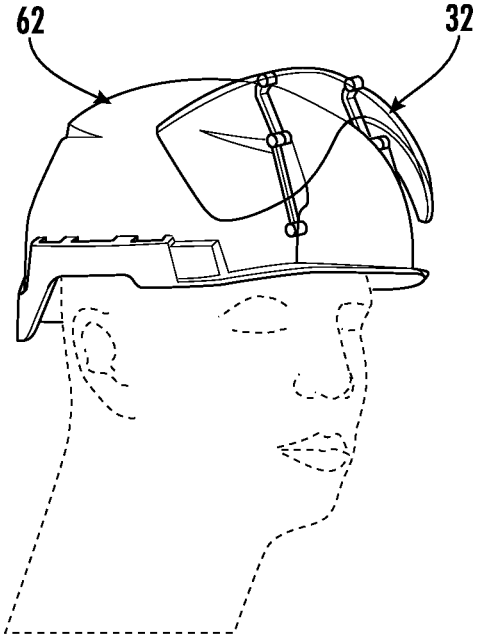
FIG. 9 is a perspective view of the hard hat system of FIG. 8, according to an exemplary embodiment.
Figure 10:
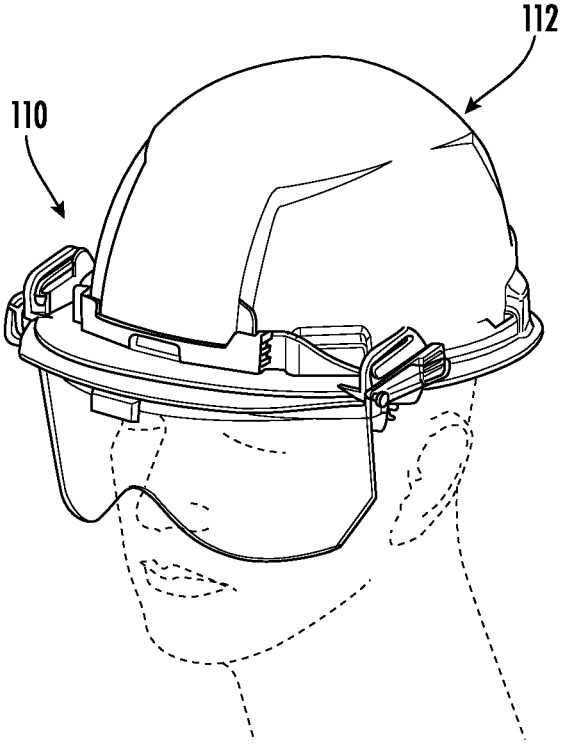
FIG. 10 is a perspective view of a hard hat system including a face shield, according to an exemplary embodiment.
Figure 11:
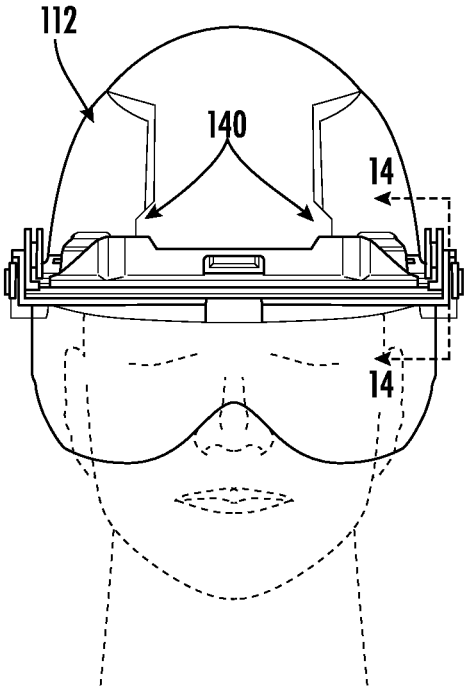
FIG. 11 is a front view of the hard hat system of FIG. 10, according to an exemplary embodiment.

Referring to FIGS. 8 and 9, various aspects of face shield 32 operating in cooperation with hard hat 62 without a bill are shown. Hard hat 62 is similar to hard hat 12 with the exception of the differences described, including that hard hat 62 does not have a bill and/or hard hat 62 has a bill with a reduced size compared to hard hat 12. Referring to FIG. 8, when face shield 32 is in the operating position, first arm 26 remain vertical and/or nearly vertical so the face shield 32 aligns with the front of hard hat 62.

Referring to FIGS. 10-32, various aspects of face shield assembly 110 are shown. Face shield assembly 110 is similar to face shield assembly 10 with the exception of the differences described. Adjustable frame 122 is slideably and pivotally coupled to hard hat 112. Face shield 132 is coupled to adjustable frame 122.

In a specific embodiment, mounting bracket 124 is fixedly coupled to hard hat 112, adjustable frame 122 is slideably and pivotally coupled coupled to mounting bracket 124, and adjustable frame 122 is therefore coupled to hard hat 112 via mounting bracket 124. In a specific embodiment, adjustable frame 122 includes a plurality of arms 126 that extend rearward from a front portion of adjustable frame 122. Each of the arms 126 includes a first protrusion 128 and a second protrusion 130 rearward of first protrusion 128.

Mounting bracket 124 includes a plurality of slots 134 that receive first protrusion 128 and second protrusion 130. Each slot 134 includes an upper portion 136 and a lower portion 138. As will be described in more detail below, first protrusion 128 and second protrusion 130 slide within slot 134 as face shield 132 actuates between an operating position and a stowed position.

Figure 12:
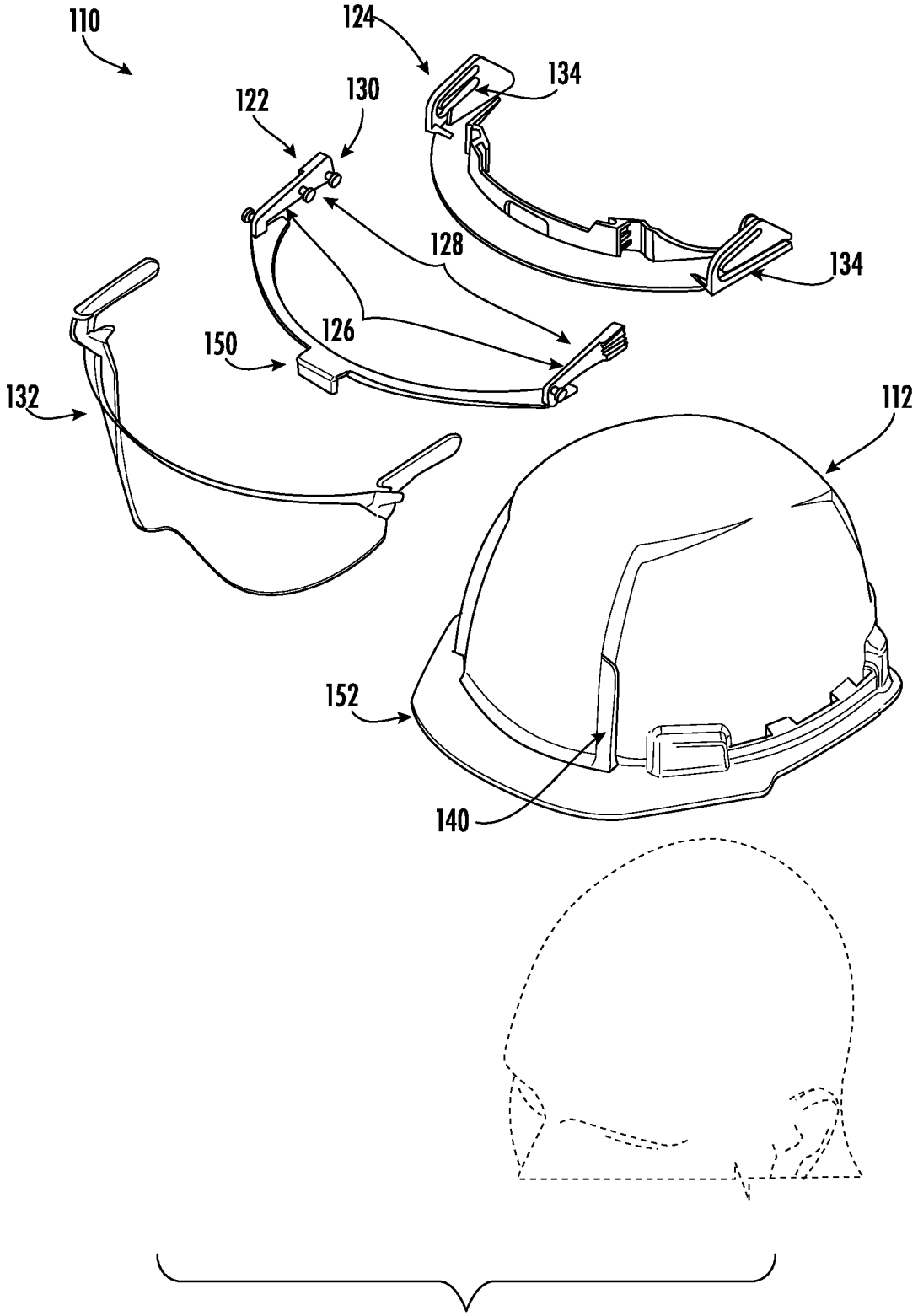
FIG. 12 is an exploded perspective view of the hard hat system of FIG. 10, according to an exemplary embodiment.

In a specific embodiment, mounting bracket 124 is coupled to ribs 140. Ribs 140 extend upwards from bill 152 and extend circumferentially away from each other (FIG. 12). In a specific embodiment, when mounting bracket 124 is coupled to ribs 140, ribs 140 extend upwardly and away from mounting bracket 124 thereby exposing a portion of ribs 140. The exposed portion of ribs 140 is available for other accessories to couple to hard hat 112 above mounting bracket 124.

Referring to FIGS. 13-20, an exemplary method of actuating face shield 132 from an operating position (FIG. 13) to a stowed position (FIG. 19) is shown.

Figure 13:
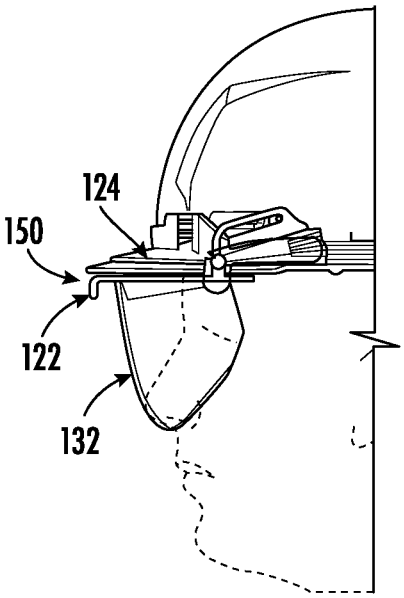
FIG. 13 is a side view of the hard hat system of FIG. 10, according to an exemplary embodiment.
Figure 14:
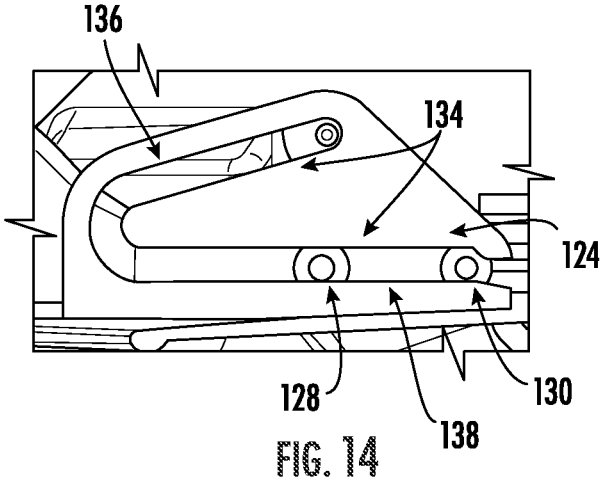
FIG. 14 is a cross-section view of the hard hat system of FIG. 10 taken alone line 14-14 in FIG. 11, according to an exemplary embodiment.

FIG. 14 depicts the location of first protrusion 128 and second protrusion 130 in slot 134 when face shield 132 is in the position shown in FIG. 13. When face shield 132 is in the operating position (FIG. 13), first protrusion 128 and second protrusion 130 are in lower portion 138 of slot 134 (FIG. 14).

Figure 15:
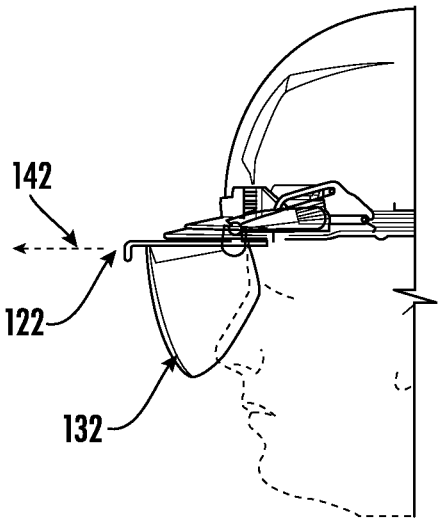
FIG. 15 is a side view of the hard hat system of FIG. 10, according to an exemplary embodiment.
Figure 16:
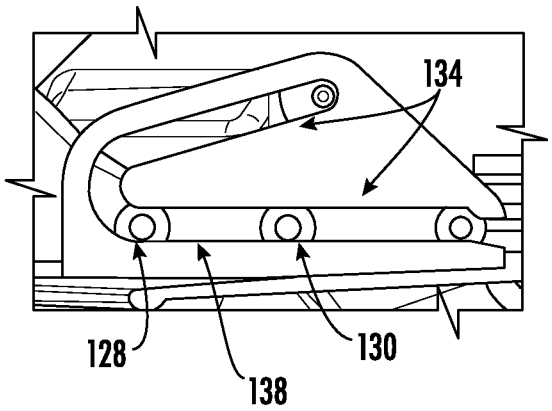
FIG. 16 is a cross-section view of the hard hat system of FIG. 10 taken alone line 14-14 in FIG. 11, according to an exemplary embodiment.

FIG. 16 depicts the location of first protrusion 128 and second protrusion 130 in slot 134 when face shield 132 is in the position shown in FIG. 15. When the operator slides face shield 132 and adjustable frame 122 in direction 142, first protrusion 128 and second protrusion 130 each slide towards a front of lower portion 138 of (FIG. 16). In one exemplary method of interfacing with adjustable frame 122, the operator interacts with an interfacing element, shown as tab 150, to pull adjustable frame 122 in direction 142. Tab 150 facilitates one-handed adjustment of face shield 132 without the operator touching face shield 132, thereby protecting face shield from smudges that cause blurred vision.

Figure 17:
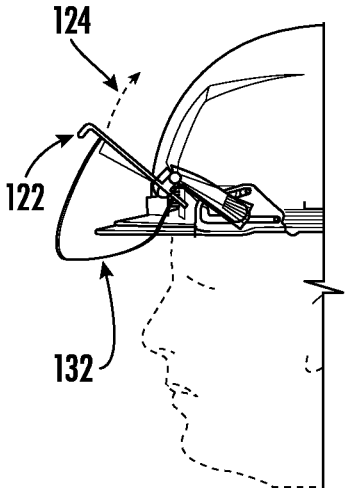
FIG. 17 is a side view of the hard hat system of FIG. 10, according to an exemplary embodiment.
Figure 18:
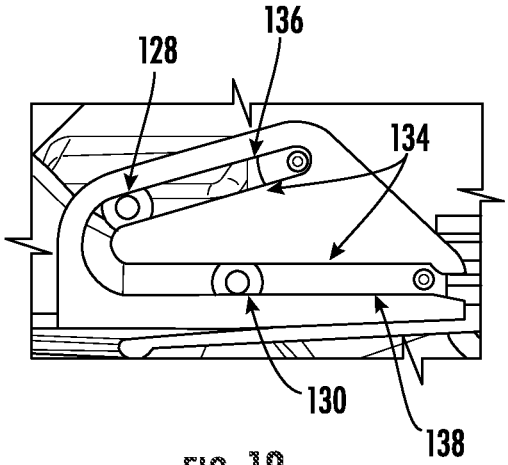
FIG. 18 is a cross-section view of the hard hat system of FIG. 10 taken alone line 14-14 in FIG. 11, according to an exemplary embodiment.

FIG. 18 depicts the location of first protrusion 128 and second protrusion 130 in slot 134 when face shield 132 is in the position shown in FIG. 17. When the operator rotates face shield 132 and adjustable frame 122 in direction 144, first protrusion 128 slides into a front of upper portion 136, and second protrusion 130 slides towards a middle of lower portion 138 (FIG. 18).

Figure 19:
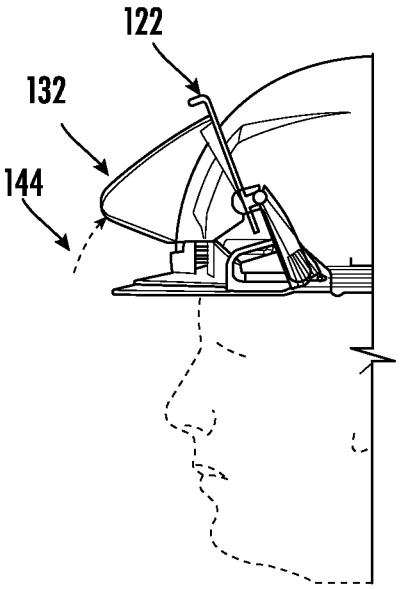
FIG. 19 is a side view of the hard hat system of FIG. 10, according to an exemplary embodiment.
Figure 20:
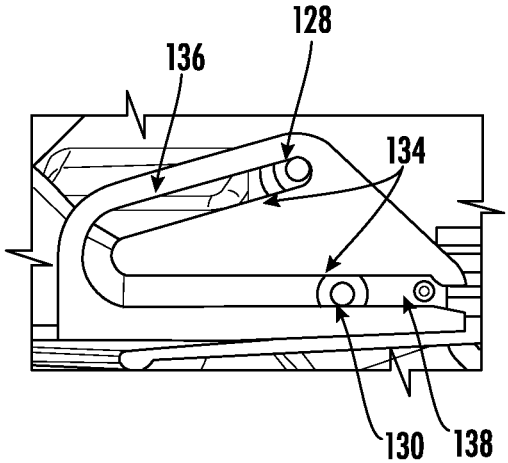
FIG. 20 is a cross-section view of the hard hat system of FIG. 10 taken alone line 14-14 in FIG. 11, according to an exemplary embodiment.

FIG. 20 depicts the location of first protrusion 128 and second protrusion 130 in slot 134 when face shield 132 is in the position shown in FIG. 19. When the operator continues rotating face shield 132 and adjustable frame 122 in direction 144 (FIG. 19), first protrusion 128 slides into a rear of upper portion 136, and second protrusion 130 slides towards a back of lower portion 138 (FIG. 18).

Figure 21:
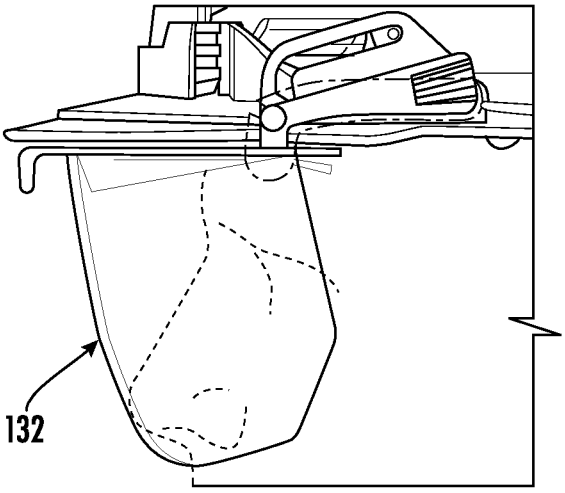
FIGS. 21-32 are various views of the hard hat system of FIG. 10, according to an exemplary embodiment.
Figure 22:
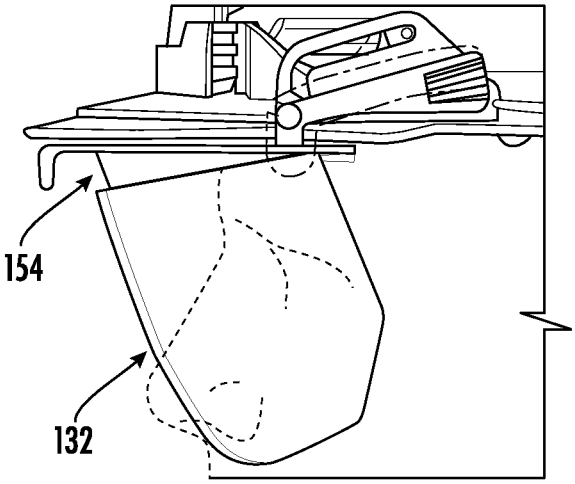
Figure 23:
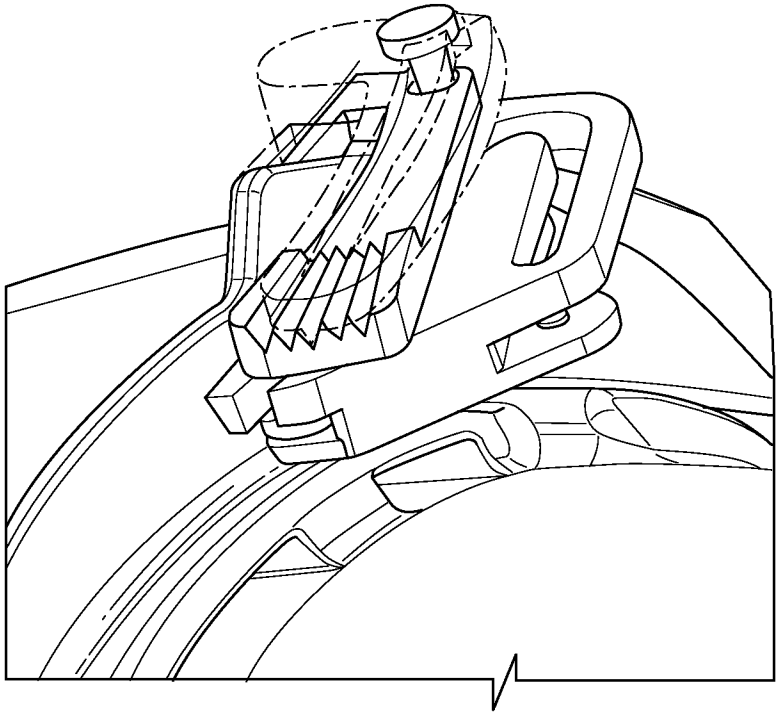
Figure 24:
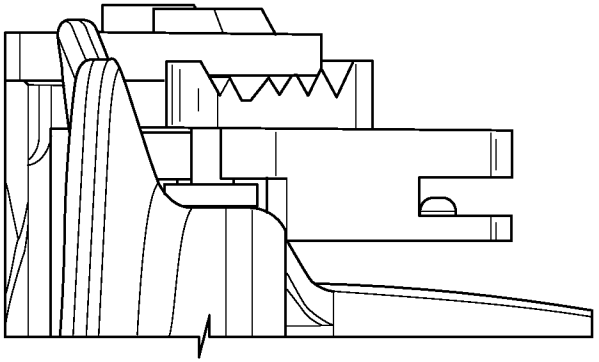
Figure 25:
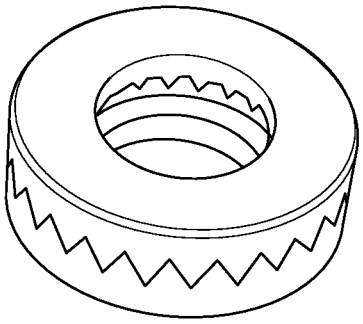
Figure 26:
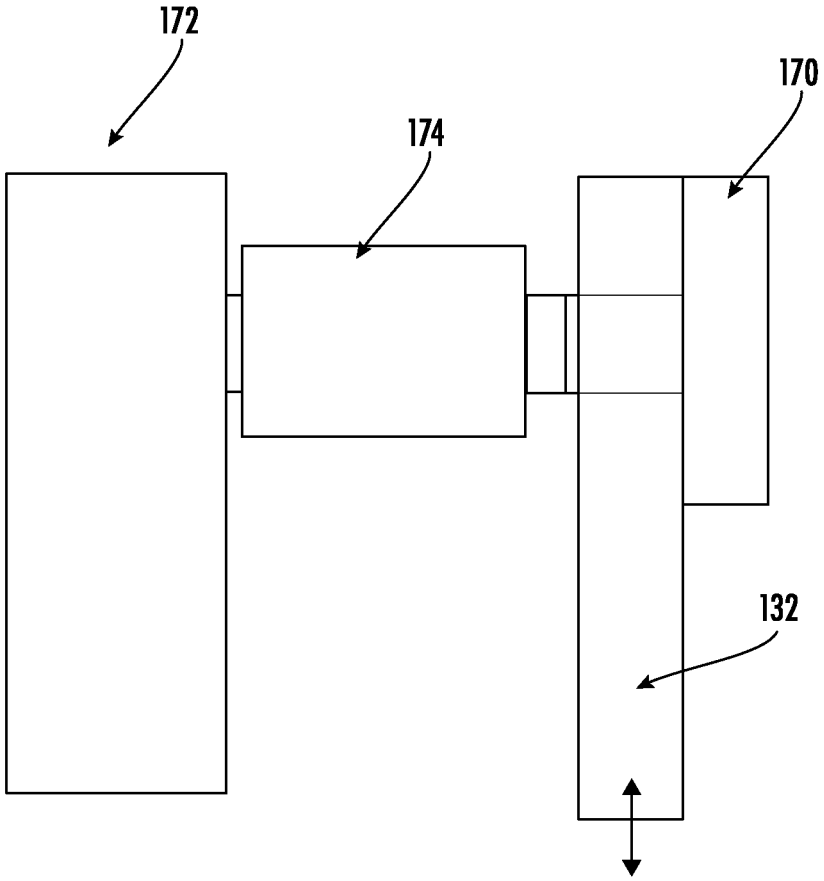
Figure 27:
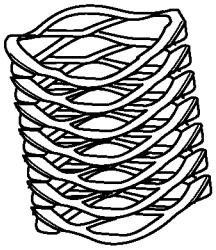
Figure 28:
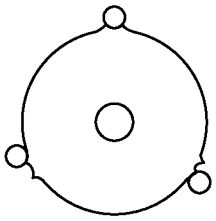
Figure 29:
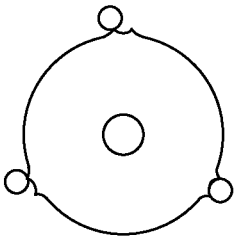
Figure 30:
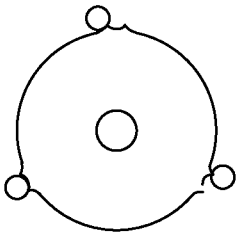
Figure 31:
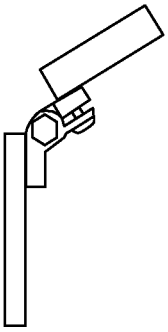
Figure 32:
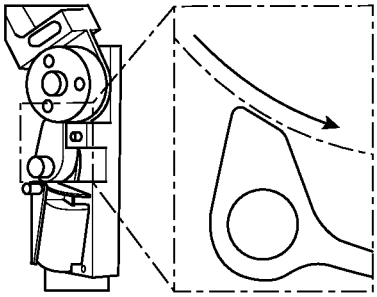

FIGS. 21-32 depict various methods and structure that may be utilized to adjust the position of the face shield. It is contemplated herein that the structures and/or methods depicted in FIGS. 21-32 may be utilized to perform micro-adjustments of the position of the face shield. These minor adjustment permit a closer personalized fit to the face of the operator, thereby allowing users to use prescription glasses in conjunction with the face shield. In a specific embodiment face shield 132 can be rotated up and down with respect to adjustable frame 122 (FIGS. 21-23). Wall 154 extends downwardly from a top of adjustable frame 122, thereby permitting face shield 132 to be rotated downward with respect to adjustable frame 122 while maintaining safety protection for the face of operator. In various embodiments, face shield includes a coupling device, shown as bolt 170, a biasing element, shown as wave spring 174, and a second coupling element, shown as brim with nut 172, which is detachably coupled to bolt 170 with wave spring 174 extending along the shaft of bolt 170. In various embodiments a biasing element, shown as wave spring (FIG. 27) is utilized to facilitate adjusting face shield 132. Other adjustment mechanisms include offset dimples (FIGS. 28-30) and/or a friction fit (FIGS. 31-32).

Figure 33:
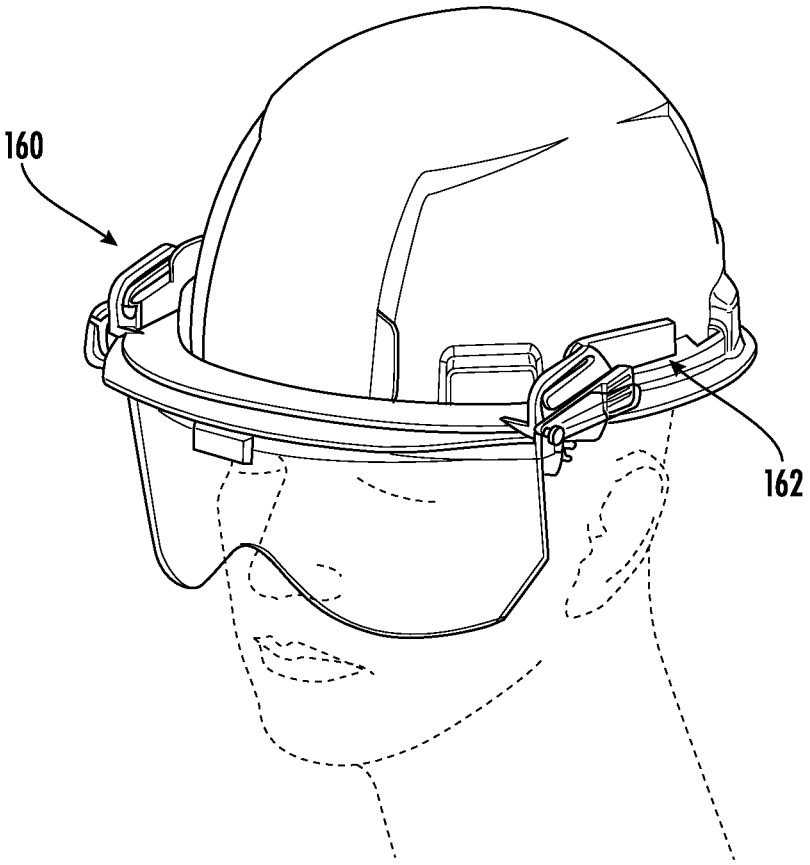
FIG. 33 is a perspective view of a hard hat system including a face shield, according to an exemplary embodiment.
Figure 34:
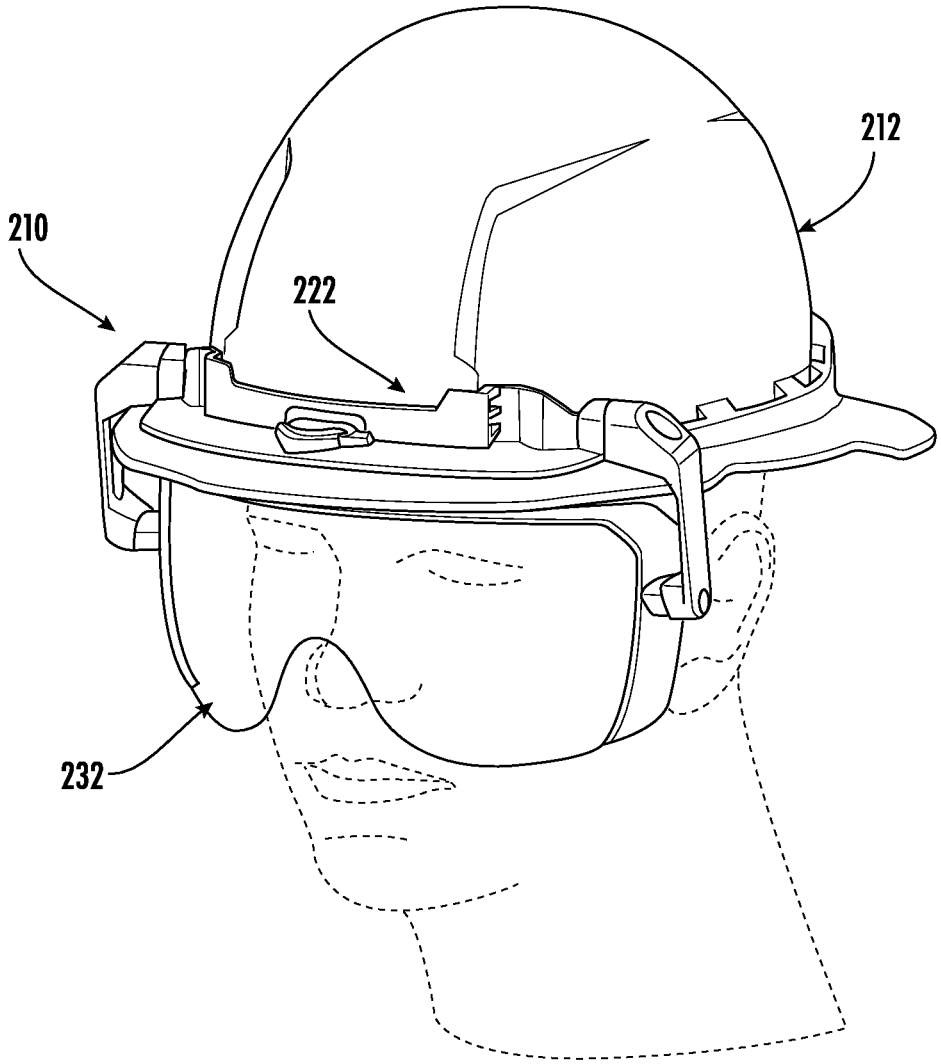
FIG. 34 is a perspective view of a hard hat system including a face shield, according to an exemplary embodiment.
Figure 35:
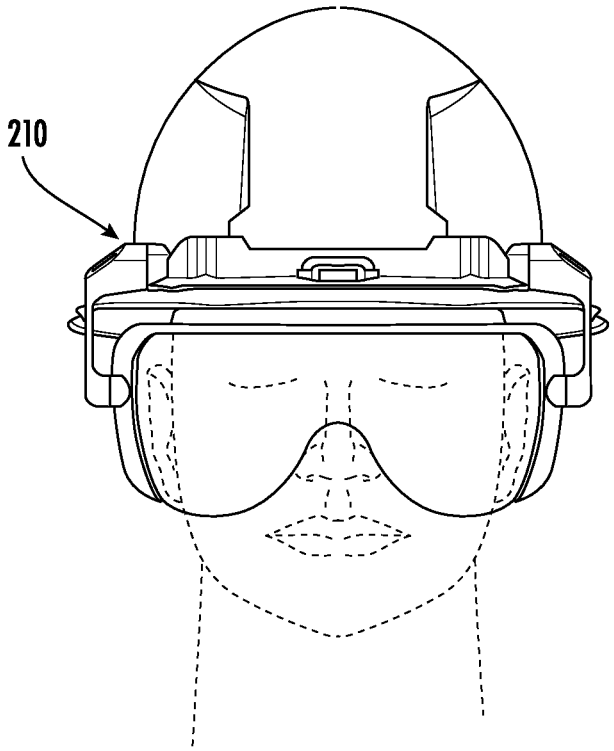
FIG. 35 is a front view of the hard hat system of FIG. 34, according to an exemplary embodiment.
Figure 36:
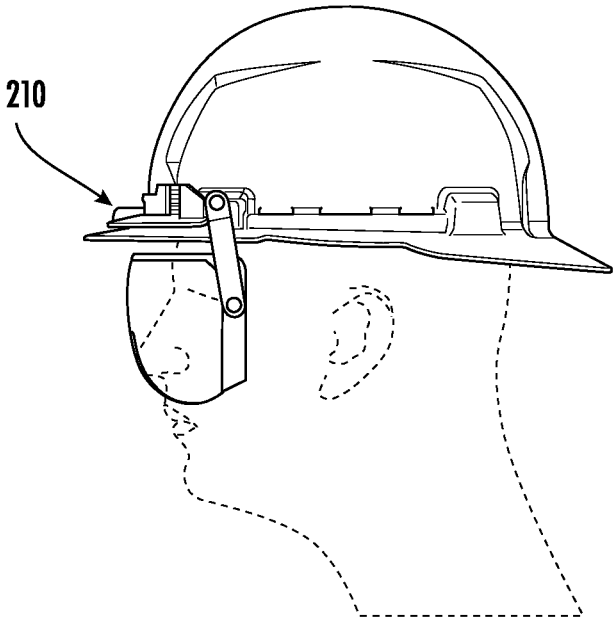
FIG. 36 is a side view of the hard hat system of FIG. 34, according to an exemplary embodiment.

Referring to FIG. 33, various aspects of face shield assembly 160 are shown. Face shield assembly 160 is similar to face shield assembly 10 and face shield assembly 110 with the exception of the differences described. Mounting bracket 162 of face shield assembly 160 is coupled to an opening or aperture, shown as a universal slot, at the side of the hard hat.

Referring to FIGS. 34-46, various aspects of face shield assembly 210 are shown. Face shield assembly 210 is similar to face shield assembly 10 and face shield assembly 110 with the exception of the differences described.

Figure 37:
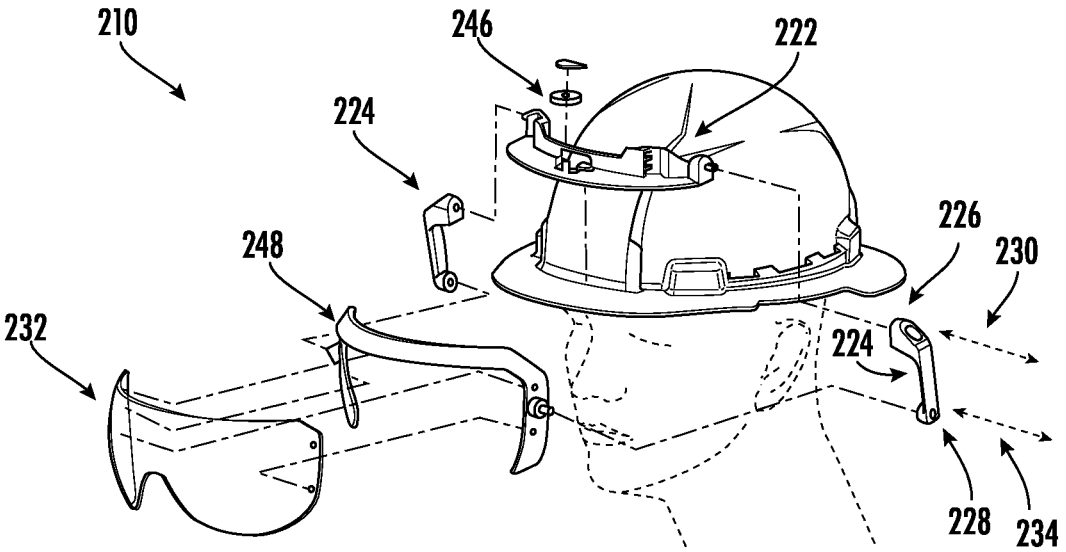
FIG. 37 is an exploded perspective view of the hard hat system of FIG. 34, according to an exemplary embodiment.
Figure 38:
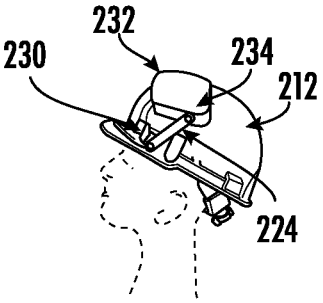
FIG. 38 is a side view of the hard hat system of FIG. 34, according to an exemplary embodiment.

Referring to FIG. 37, mounting bracket 222 is configured to couple to hard hat 212. Arm 224 is pivotally coupled to mounting bracket 222 at a first end 226 of arm 224 opposite second end 228. Arm 224 pivots with respect to mounting bracket 222 around a first axis 230.

Face shield 232 is pivotally coupled to second end 228 of arm 224. Face shield 232 pivots with respect to arm 224 around second axis 234.

Mounting bracket 222 is coupled to hard hat 212 via fastener 246. Arms 224 are pivotally coupled to mounting bracket 222. Frame 248 is pivotally coupled to arms 224, and face shield 232 is coupled to frame 248.

Figure 39:
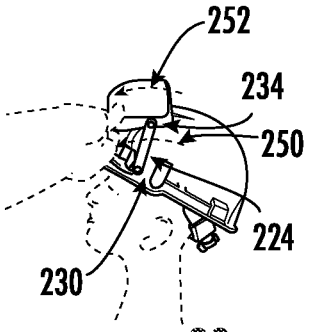
FIG. 39 is a side view of the hard hat system of FIG. 34, according to an exemplary embodiment.
Figure 40:
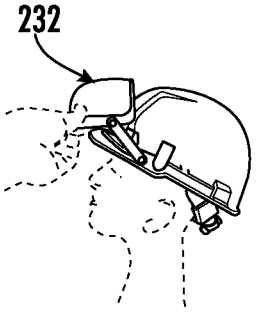
FIG. 40 is a side view of the hard hat system of FIG. 34, according to an exemplary embodiment.
Figure 41:
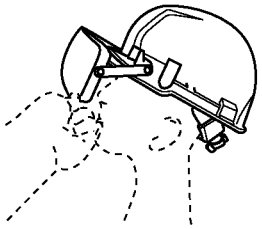
FIG. 41 is a side view of the hard hat system of FIG. 34, according to an exemplary embodiment.
Figure 42:
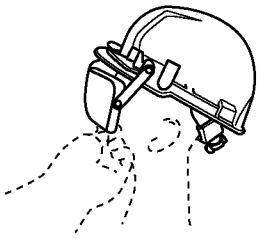
FIG. 42 is a side view of the hard hat system of FIG. 34, according to an exemplary embodiment.
Figure 43:
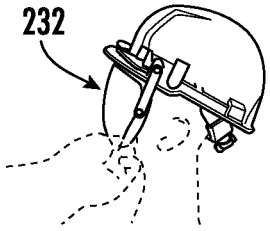
FIG. 43 is a side view of the hard hat system of FIG. 34, according to an exemplary embodiment.
Figure 44:
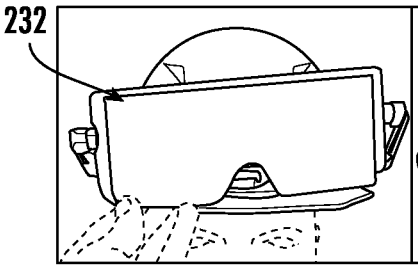
FIG. 44 is a front view from the front of the hard hat system of FIG. 34, according to an exemplary embodiment.
Figure 45:
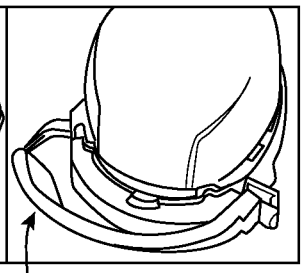
FIG. 45 is a perspective view from above of the hard hat system of FIG. 34, according to an exemplary embodiment.
Figure 46:
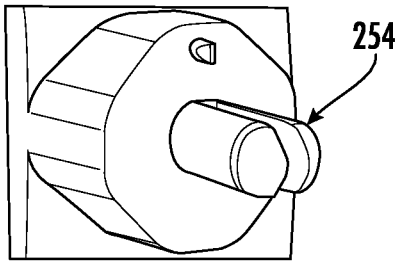
FIG. 46 is a detailed perspective view of a post of the hard hat system of FIG. 34, according to an exemplary embodiment.
Figure 47:
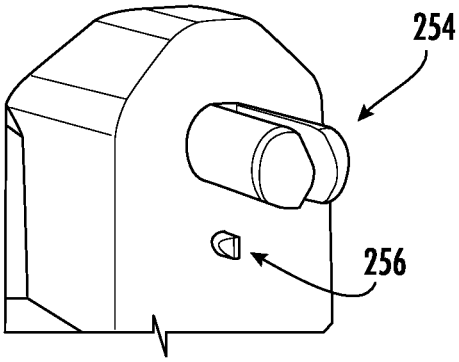
FIGS. 47-50 are various views of aspects of the hard hat system of FIG. 34, according to an exemplary embodiment.
Figure 48:
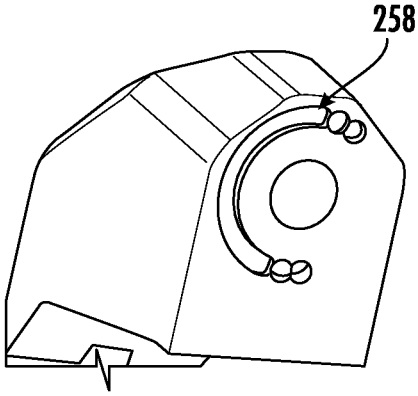

Referring to FIGS. 38-43, an exemplary method of actuating face shield 232 from a stowed position (FIG. 38) to an operating position (FIG. 43) is shown. Referring to FIG. 39, an operator rotates face shield 232 in direction 252 with respect to arm 224 around second axis 234. The operator also rotates arm 224 in direction 250 with respect to hard hat 212 around first axis 230. Face shield 232 and arm 224 continue to be rotated until face shield 232 is in the operating position (FIG. 43).

Post 254 (FIG. 46) extends from one or more of mounting bracket 222, arm 224, and/or frame 248 to facilitate the rotation described in FIGS. 38-43. In a specific embodiment, post 254 extends a distance of at least 8 mm.

Figure 49:
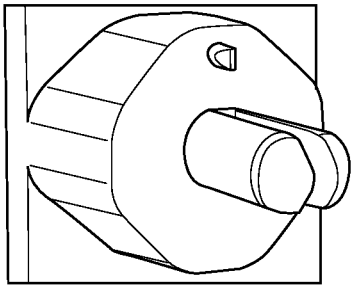
Figure 50:
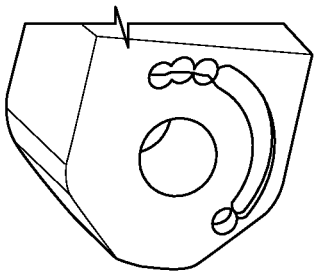
Figure 51:
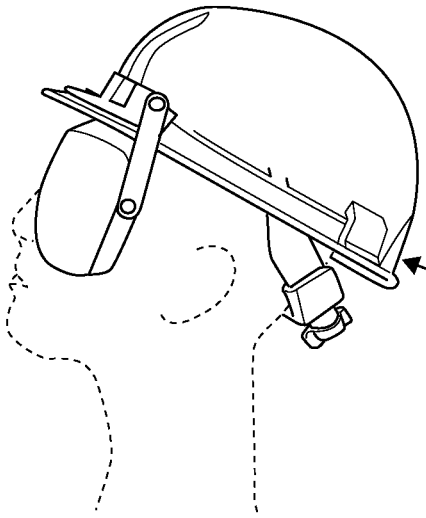
FIGS. 51-54 are various views of the hard hat system of FIG. 34, according to an exemplary embodiment.
Figure 52:
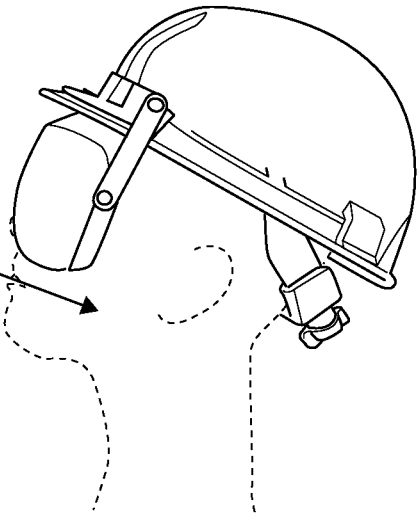
Figure 53:
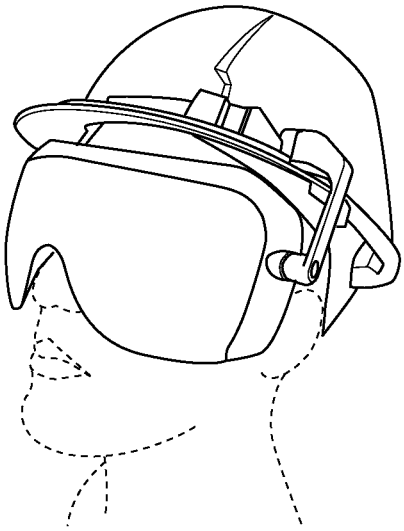
Figure 54:
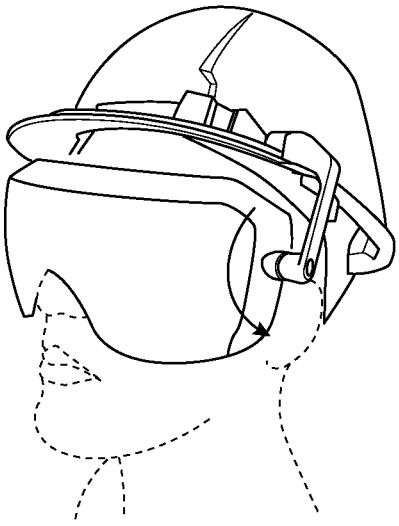

Referring to FIGS. 47-50, various aspects of rotating face shield assembly 210 are shown. Secondary post 256 (FIG. 47) extends within slot 258 (FIG. 48) while face shield 232 is being pivoted between the operating position and the stowed position. Referring to FIGS. 49-50, various aspects of facilitating minor adjustments to face shield 232 are shown, including for example micro dimples (FIG. 50) with which a post (FIG. 49) interfaces.

Referring to FIGS. 51-54, various aspects of positioning face shield assembly 210 are shown. Face shield 232 can be adjusted forward and backward (compare FIG. 51 and FIG. 52), and face shield 232 can be tilted up and down (compare FIG. 53 and FIG. 54).

Figure 55:
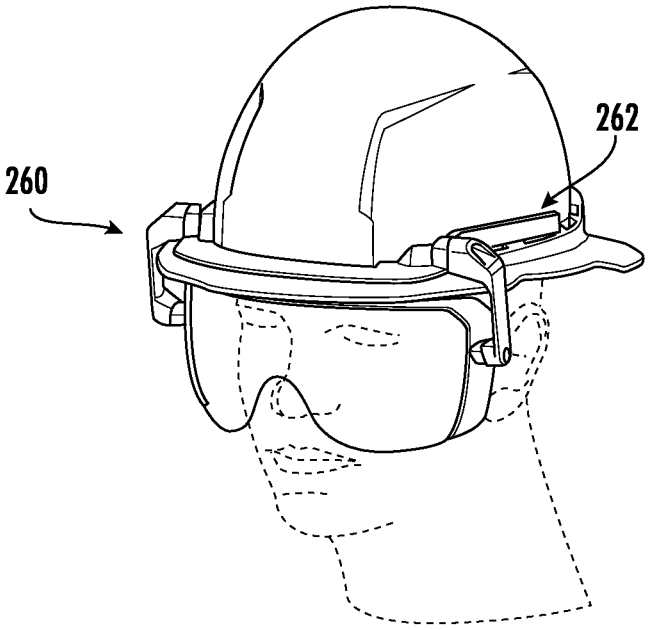
FIG. 55 is a perspective view of a hard hat system including a face shield, according to an exemplary embodiment.

Referring to FIG. 55, various aspects of face shield assembly 260 are shown. Face shield assembly 260 is similar to face shield assembly 210 with the exception of the differences described. Mounting bracket 262 of face shield assembly 260 is coupled to an opening or aperture, shown as a universal slot, at the side of the hard hat.

Figure 56:
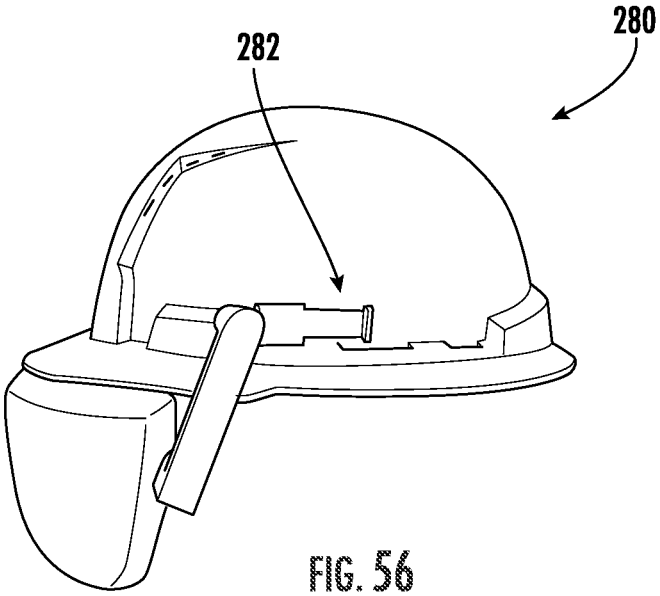
FIG. 56 is a side view of a hard hat system including a face shield, according to an exemplary embodiment.
Figure 57:
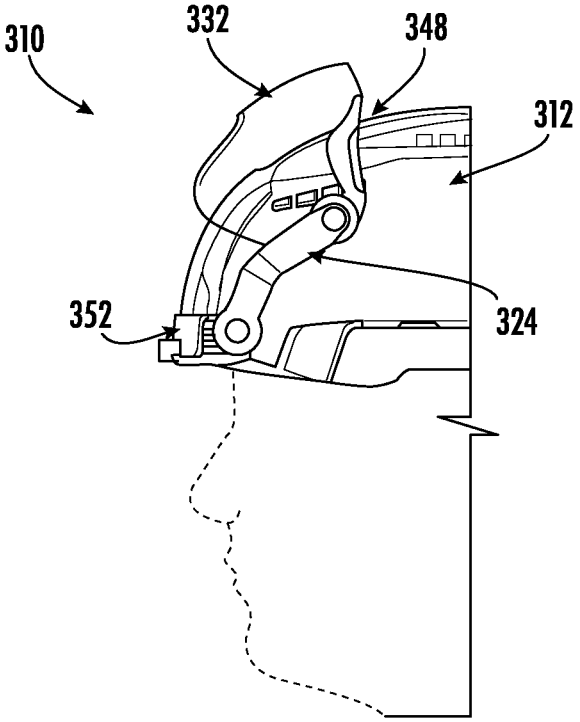
FIG. 57 is a side view of a hard hat system including a face shield, according to an exemplary embodiment.
Figure 58:
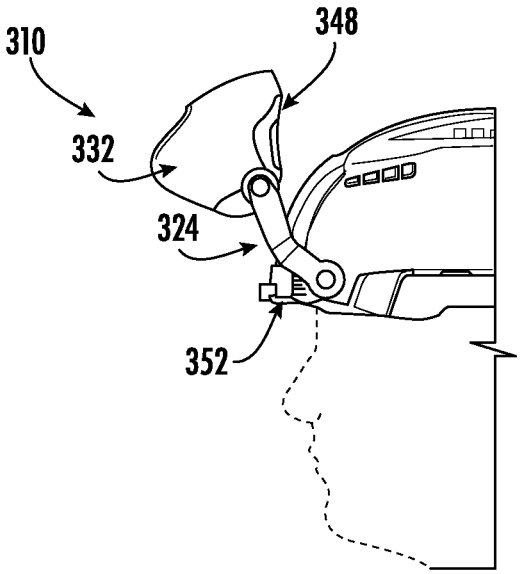
FIGS. 58-61 are side views of the hard hat system of FIG. 57, according to an exemplary embodiment.
Figure 59:
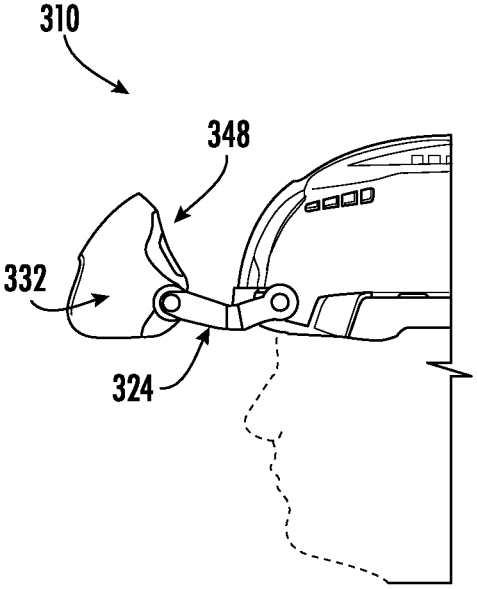

Referring to FIG. 56, various aspects of face shield assembly 280 are shown. Face shield assembly 280 is similar to face shield assembly 260 with the exception of the differences described. Mounting bracket 282 of face shield assembly 280 does not extend across a top center portion of bill of the hard hat, unlike mounting bracket 262 of face shield assembly 260 (FIG. 55).

Referring to FIGS. 57-76, various aspects of face shield assembly 310 are shown. Face shield assembly 310 is substantially the same as face shield assembly 10, face shield assembly 110, face shield assembly 160, face shield assembly 210, face shield assembly 260, or face shield assembly 280 except for the differences discussed herein.

Figure 60:
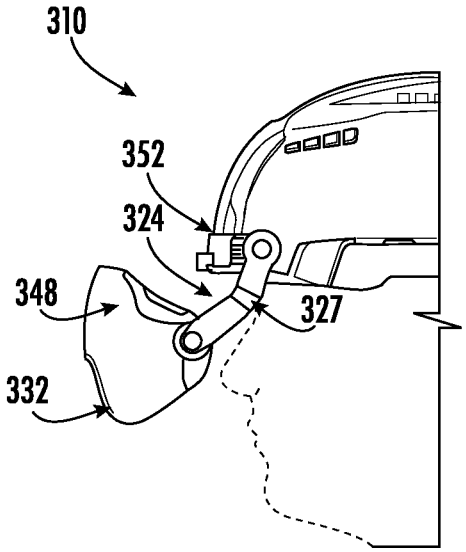
Figure 61:
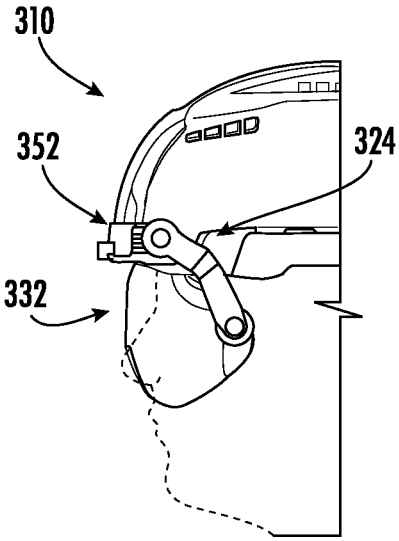
Figure 62:
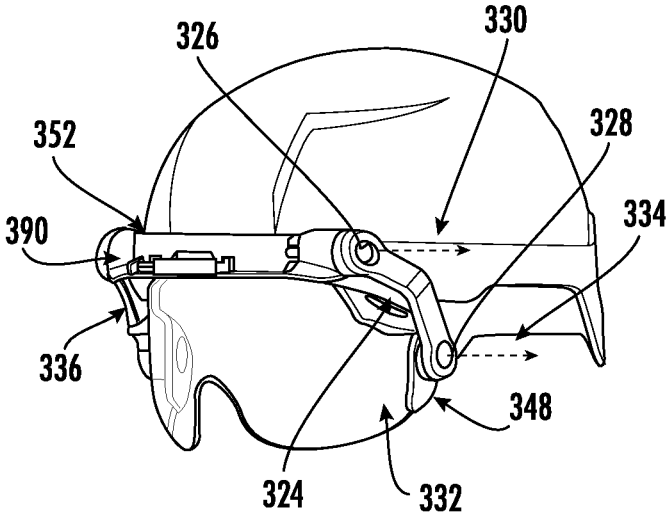
FIG. 62 is a perspective view of the hard hat system of FIG. 57, according to an exemplary embodiment.

Referring to FIGS. 57-61, various positions for face shield assembly 310 are shown with respect to the hard hat. An attachment portion, shown as mounting bracket 352, detachably couples to hard hat 312. In various embodiments, mounting bracket 352 is the same or similar as brim guard 610, described later. Arm 324 is pivotally coupled to mounting bracket 352, one or both of arms 324 are pivotally coupled to frame 348, and frame 348 is coupled to face shield 332. In a specific embodiment, face shield assembly 310 includes two arms 324. A protective semi-transparent shield, shown as face shield 332, is coupled to frame 348. Arm 324 rotates with respect to mounting bracket 352 from a stowed position (FIG. 57) to an operating position (FIG. 61). As face shield 332 pivots between the stowed position and the operating position, the configuration of face shield assembly 310 helps face shield 332 avoid a brim of a hard hat and/or a headlamp coupled to the hard hat that the user is wearing. Face shield 332 is substantially the same as face shield 32 except for the differences discussed herein. In various embodiments, a first arm 324 and a second arm 324 are each pivotally coupled to the mounting bracket 352 such that each of the first and second arms 324 rotate with respect to the mounting bracket 352 around a first axis 330.

In various embodiments, one or both of arms 324 include a convex portion 327 with respect to the head of the wearer when the face shield 332 is configured in the operating position. Stated another way, when face shield 332 is configured in the operating position, convex portion curves away from the head of the wearer (FIG. 60).

Referring to FIGS. 62-68, various aspects of the coupling mechanisms of face shield assembly 310 are shown. First end 326 of arm 324 is pivotally coupled to mounting bracket 352. Second end 328 of arm 324, opposite first end 326, is pivotally coupled to frame 348. Arm 324 rotates about first axis 330 with respect to mounting bracket 352, and arm 324 rotates about second axis 334 with respect to frame 348. Stated another way, frame 348 pivotally rotates with respect to each of the first arm 324 and the second arm 324 about a second axis 334. In various embodiments, frame 348 is rigidly coupled to the face shield 332. In various embodiments and as will be explained, frame 348 is mechanically detachably coupled to the face shield 332.

Figure 63:
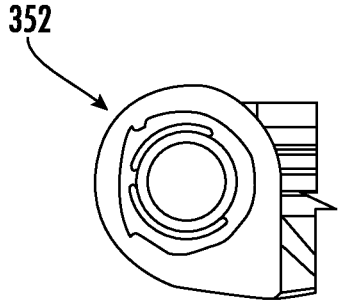
FIG. 63 is a side view of a portion of the mounting element of the hard hat system of FIG. 57, according to an exemplary embodiment.
Figure 64:
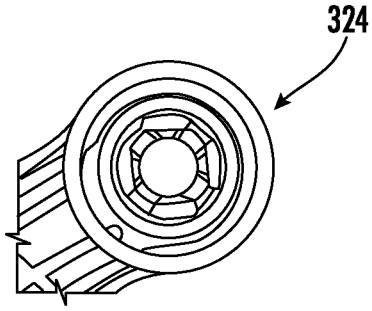
FIG. 64 is a side view of a portion of the pivot arm of the hard hat system of FIG. 57, according to an exemplary embodiment.
Figure 65:
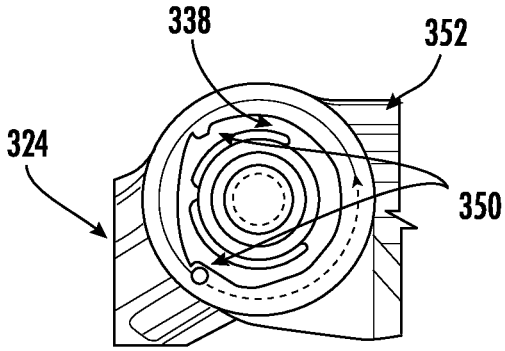
FIG. 65 is a silhouette side view of a portion of mounting element and pivot arm of the hard hat system of FIG. 57, according to an exemplary embodiment.

Referring to FIGS. 63-65, various aspects of the coupling between mounting bracket 352 and arm 324 are shown. In various embodiments, mounting bracket 352 and/or arm 324 includes one or more detents to bias mounting bracket 352 and arm 324 to remain in certain configurations with respect to each other. In a specific embodiment, mounting bracket 352 includes detents 350. A biasing element, shown as spring 338, biases mounting bracket 352 and arm 324 to remain in-place with respect to each other even when the mounting bracket 352 and arm 324 are between the detent positions. In a specific embodiment, mounting bracket 352 and arm 324 can move up to 260 degrees with respect to each other. In a specific embodiment, mounting bracket 352 and arm 324 can be positioned between 25 degrees and 40 degrees off vertical (e.g., the face shield can be positioned between 25 degrees and 40 degrees off vertical).

Figure 66:
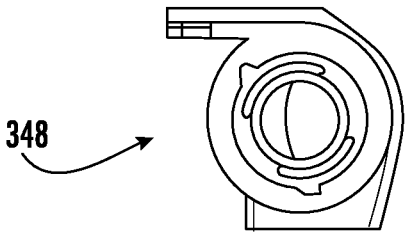
FIG. 66 is a side view of a portion of the frame of the hard hat system of FIG. 57, according to an exemplary embodiment.
Figure 67:
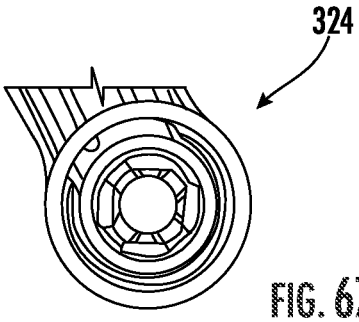
FIG. 67 is a side view of a portion of the pivot arm of the hard hat system of FIG. 57, according to an exemplary embodiment.
Figure 68:
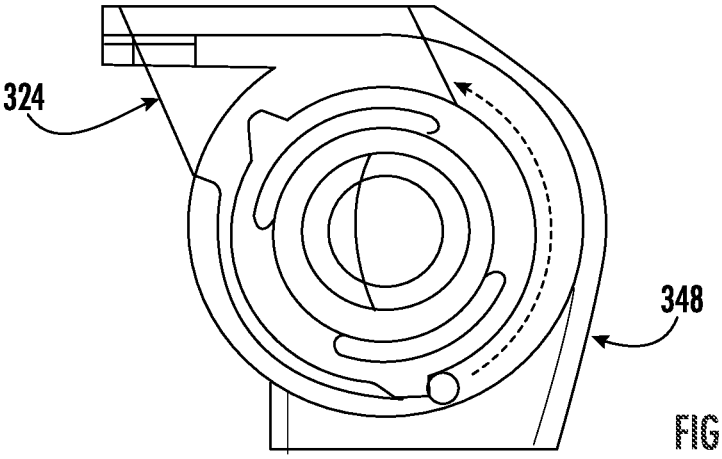
FIG. 68 is a silhouette side view of a portion of frame and pivot arm of the hard hat system of FIG. 57, according to an exemplary embodiment.
Figure 69:
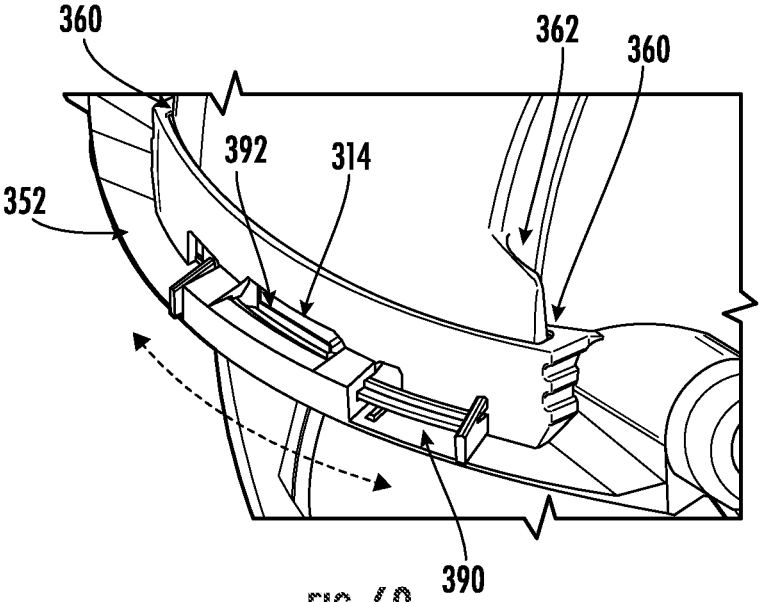
FIG. 69 is a partial perspective view of the hard hat system of FIG. 57, according to an exemplary embodiment.

Referring to FIGS. 66-68, various aspects of the coupling between frame 348 and arm 324 are shown. In various embodiments, the interface between frame 348 and arm 324 creates a friction fit to bias frame 348 and arm 324 to remain in-place with respect to each other. In a specific embodiment, frame 348 and arm 324 have 200 degrees range of motion with respect to each other. In a specific embodiment, frame 348 and arm 324 can be positioned between 25 degrees and 40 degrees off vertical (e.g., the face shield can be positioned between 25 degrees and 40 degrees off vertical).

Figure 70:
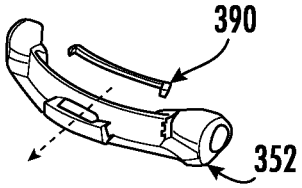
FIG. 70 is a perspective view of the mounting element and slide lock of the hard hat system of FIG. 57, according to an exemplary embodiment.
Figure 71:
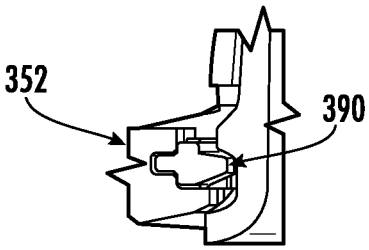
FIG. 71 is a cross-section view of the mounting element and slide lock of the hard hat system of FIG. 57, according to an exemplary embodiment.
Figure 72:
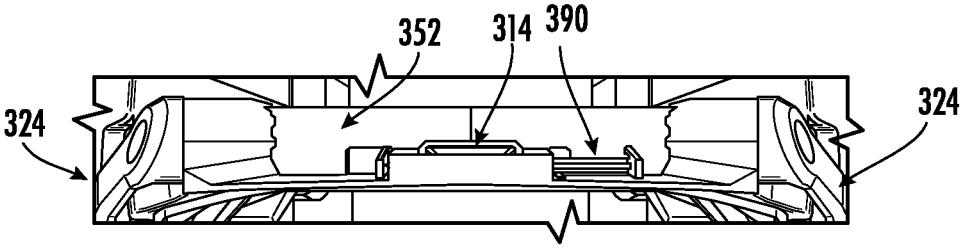
FIG. 72 is a front view of the hard hat system of FIG. 57, according to an exemplary embodiment.
Figure 73:
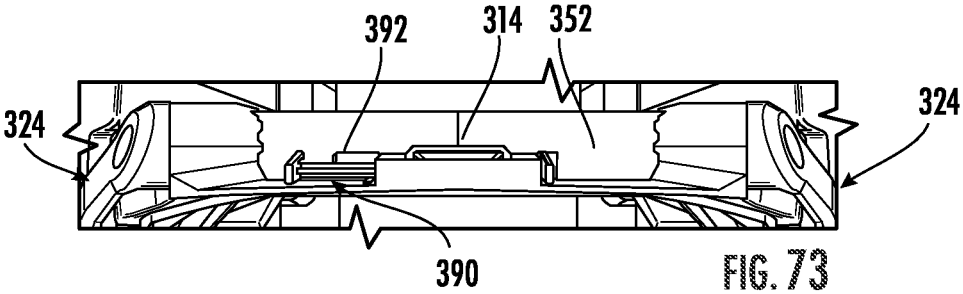
FIG. 73 is a front view of the hard hat system of FIG. 57, according to an exemplary embodiment.

Referring to FIGS. 69-73, slide lock 390 is slideably engaged with a brim guard, such as mounting bracket 352. Slide lock 390 includes a protrusion 392 that extends inwardly (e.g., towards the hard hat). When slide lock 390 is in the locked position (FIG. 72), protrusion 392 interfaces with retention feature 314 on the hard hat to secure mounting bracket 352 to the hard hat. In a specific embodiment, mounting bracket 352 couples to the hard hat at a front position and above the brim. In a specific embodiment, recesses 360 couple to projections on a front of hard hat above the brim to couple the mounting bracket 352 to the hard hat. To couple mounting bracket 352 to the hard hat, mounting bracket 352 is positioned in front of and above the front brim of the hard hat, and mounting bracket 352 is slid down so that recesses 360 engage with projections of hard hat. When slide lock 390 is in the unlocked position (FIG. 73), protrusion does not interface with retention feature 314, and as a result mounting bracket 352 can be more easily removed from the hard hat. Referring to FIG. 70, slide lock 390 can be attached and detached from mounting bracket 352, such as by slide lock 390 snapping into and out of engagement with mounting bracket 352.

Figure 74:
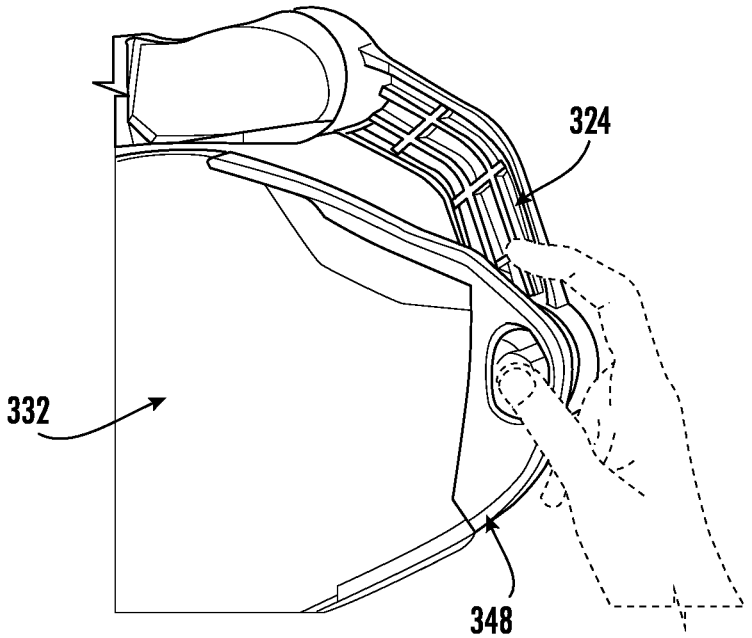
FIG. 74 is a partial rear view of the hard hat system of FIG. 57, according to an exemplary embodiment.
Figure 75:
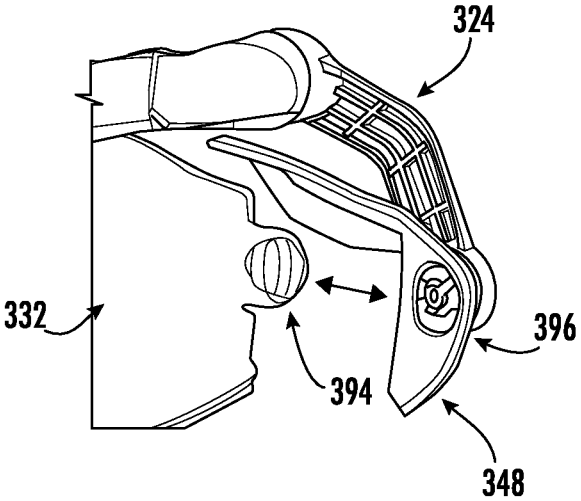
FIG. 75 is a partial rear view of the hard hat system of FIG. 57, according to an exemplary embodiment.
Figure 76:
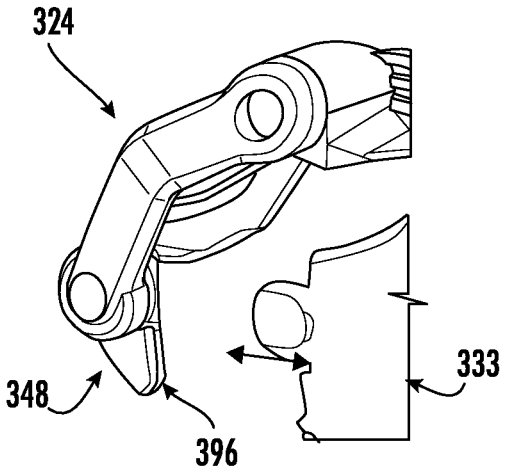
FIG. 76 is a partial rear view of the hard hat system of FIG. 57, according to an exemplary embodiment.
Figure 77:
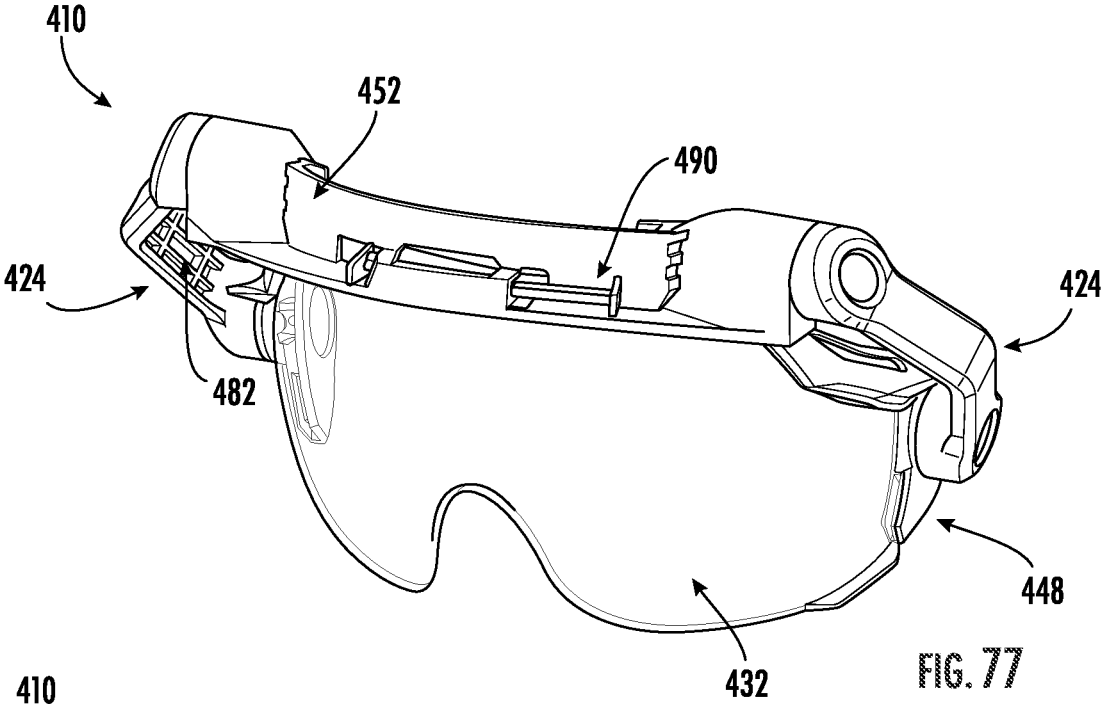
FIG. 77 is a perspective view of a hard hat system, according to an exemplary embodiment.
Figure 78:
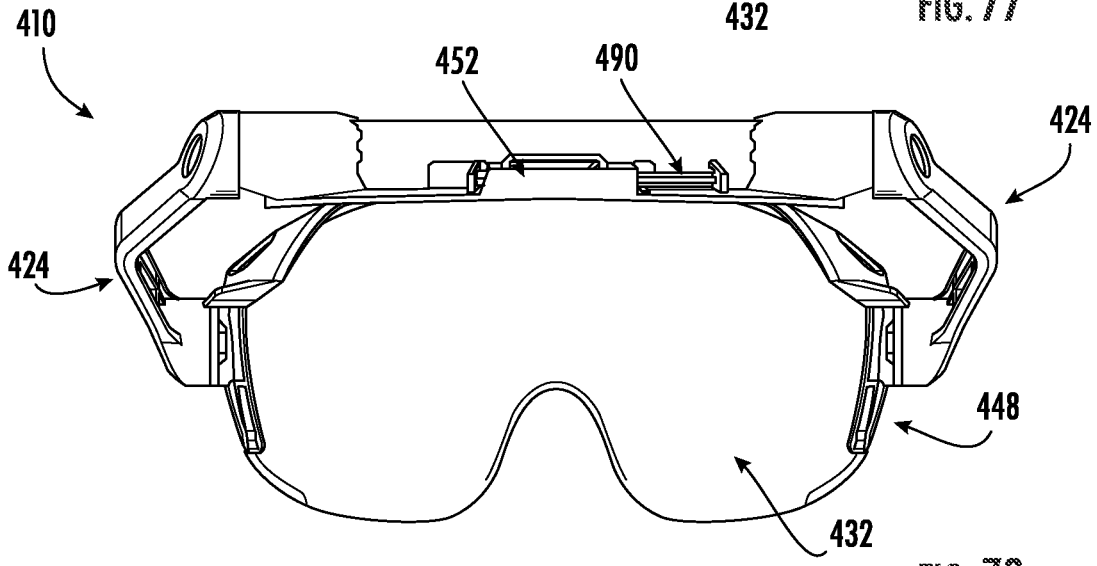
FIG. 78 is a front view of the hard hat system of FIG. 77, according to an exemplary embodiment.
Figure 79:
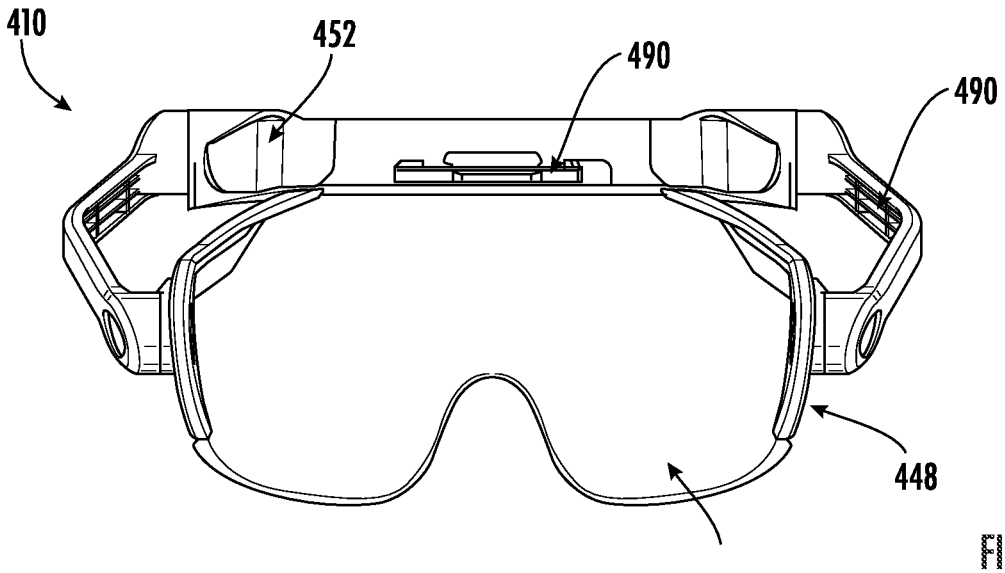
FIG. 79 is a rear view of the hard hat system of FIG. 77, according to an exemplary embodiment.
Figure 80:
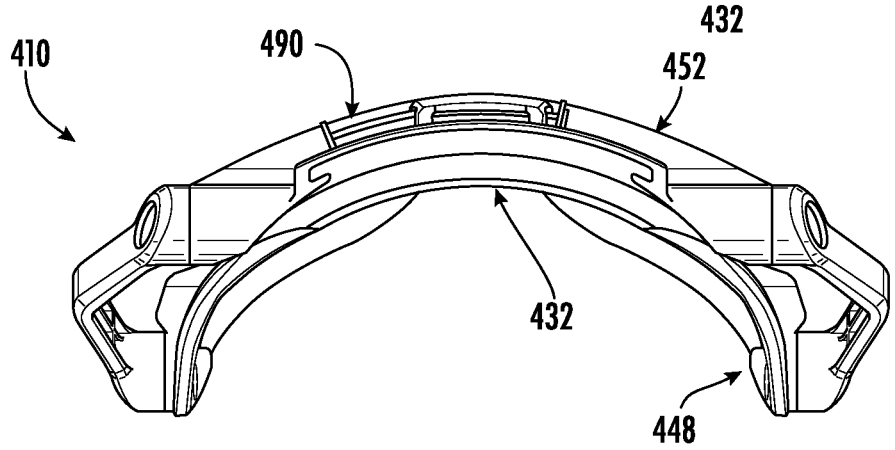
FIG. 80 is a top view of the hard hat system of FIG. 77, according to an exemplary embodiment.

Referring to FIGS. 74-76, in various embodiments face shield 332 can be removed from frame 348 and replaced with a new face shield 333. A user interfaces with attachment mechanism 394 of face shield 332 to remove face shield 332 from attachment mechanism 396 of frame 348 (FIG. 75). Then, the user attaches a new face shield 333 to frame 348 (FIG. 76).

Referring to FIGS. 77-81, various aspects of face shield assembly 410 are shown. Face shield assembly 410 is substantially the same as face shield assembly 310 except for the differences discussed herein. In particular, the support structure on the interior of arms 424 includes a different cross-hatching configuration.

Figure 81:
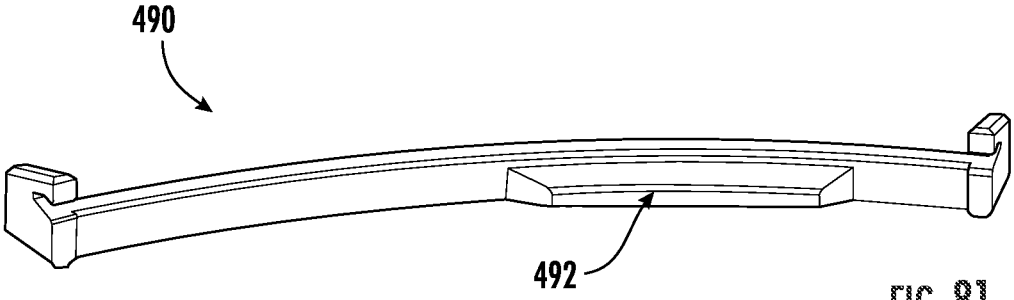
FIG. 81 is a perspective view from above and behind of the slide lock of the hard hat system of FIG. 77, according to an exemplary embodiment.
Figure 82:
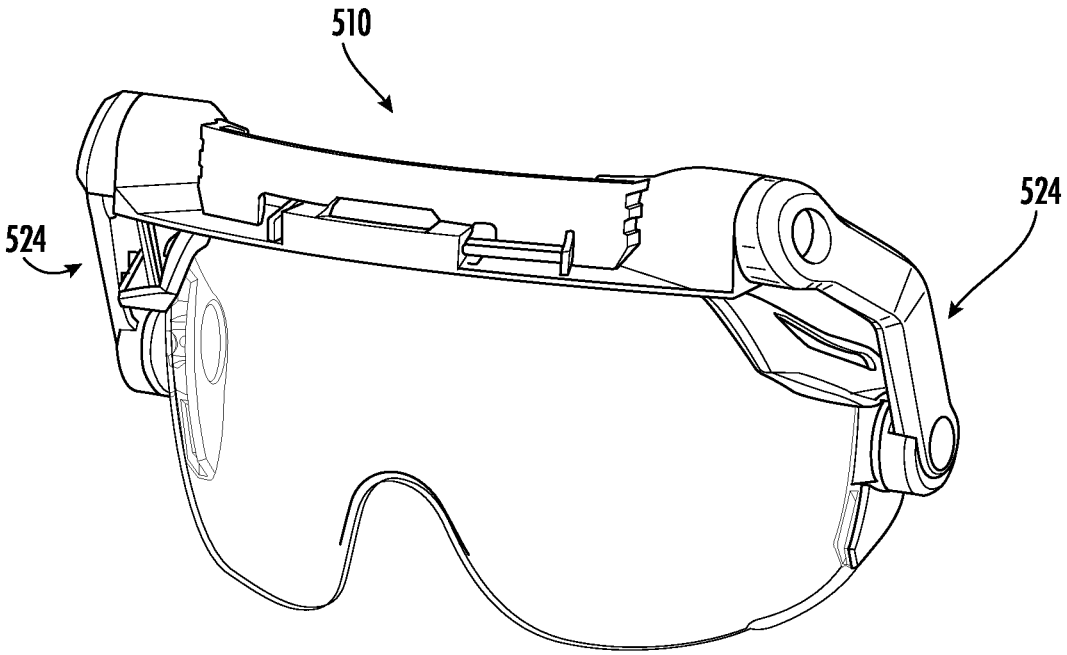
FIG. 82 is a perspective view of a hard hat system, according to an exemplary embodiment.
Figure 83:
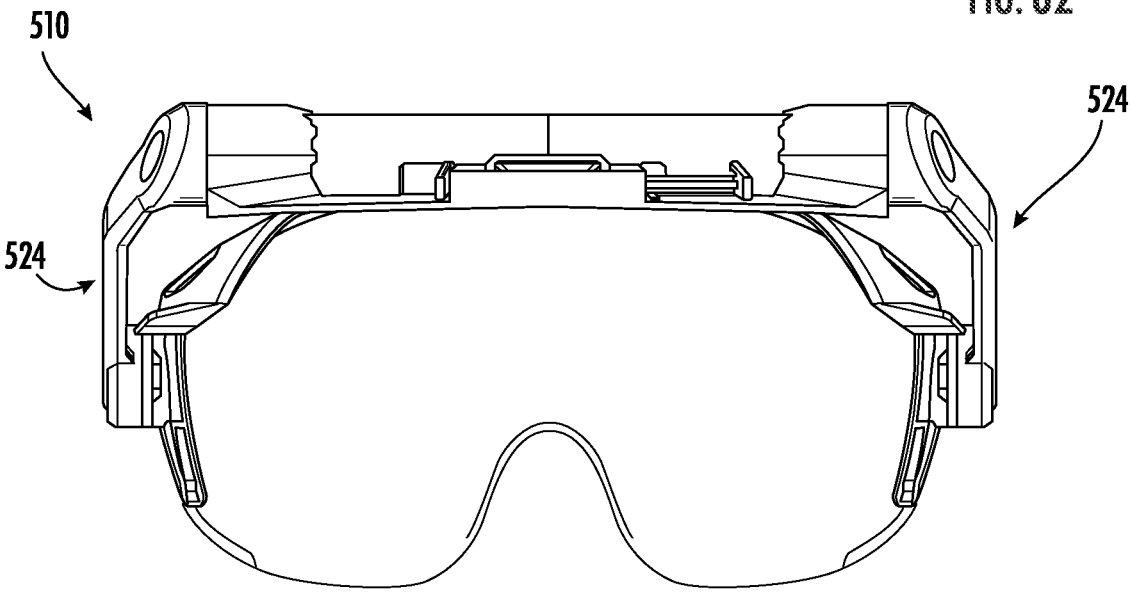
FIG. 83 is a front view of the hard hat system of FIG. 82, according to an exemplary embodiment.
Figure 84:
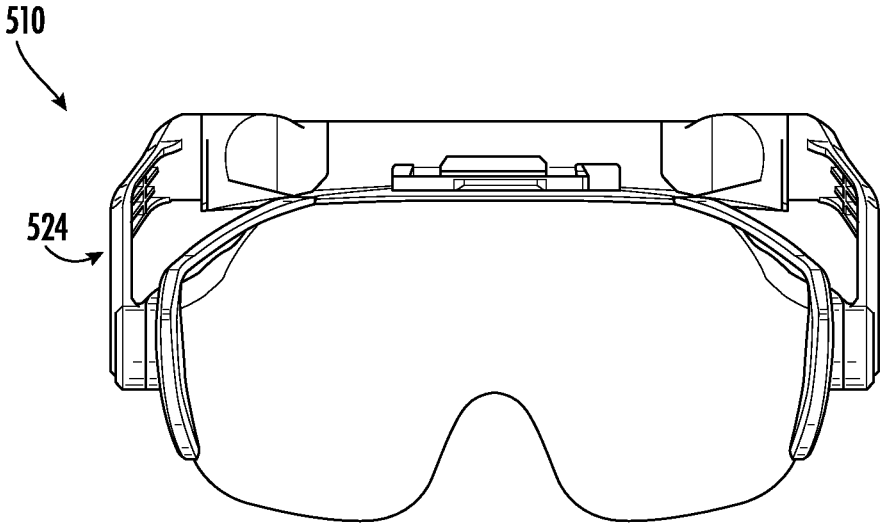
FIG. 84 is a rear view of the hard hat system of FIG. 82, according to an exemplary embodiment.
Figure 85:
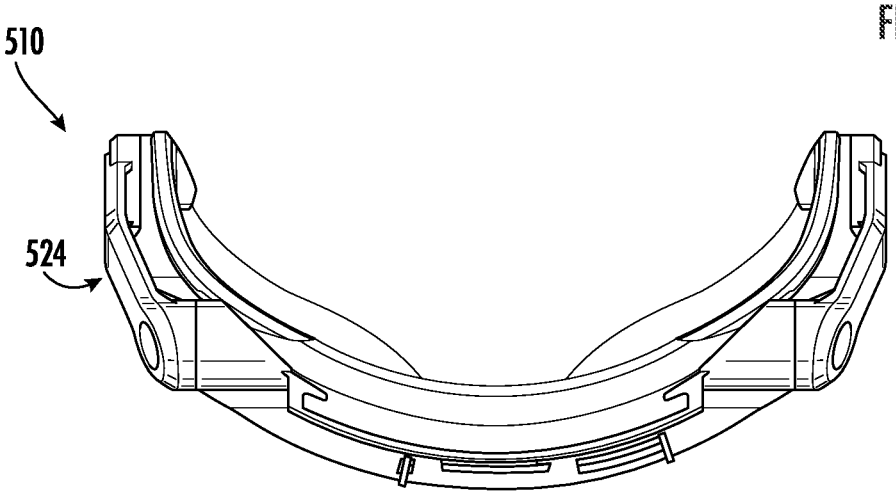
FIG. 85 is a top view of the hard hat system of FIG. 82, according to an exemplary embodiment.
Figure 86:
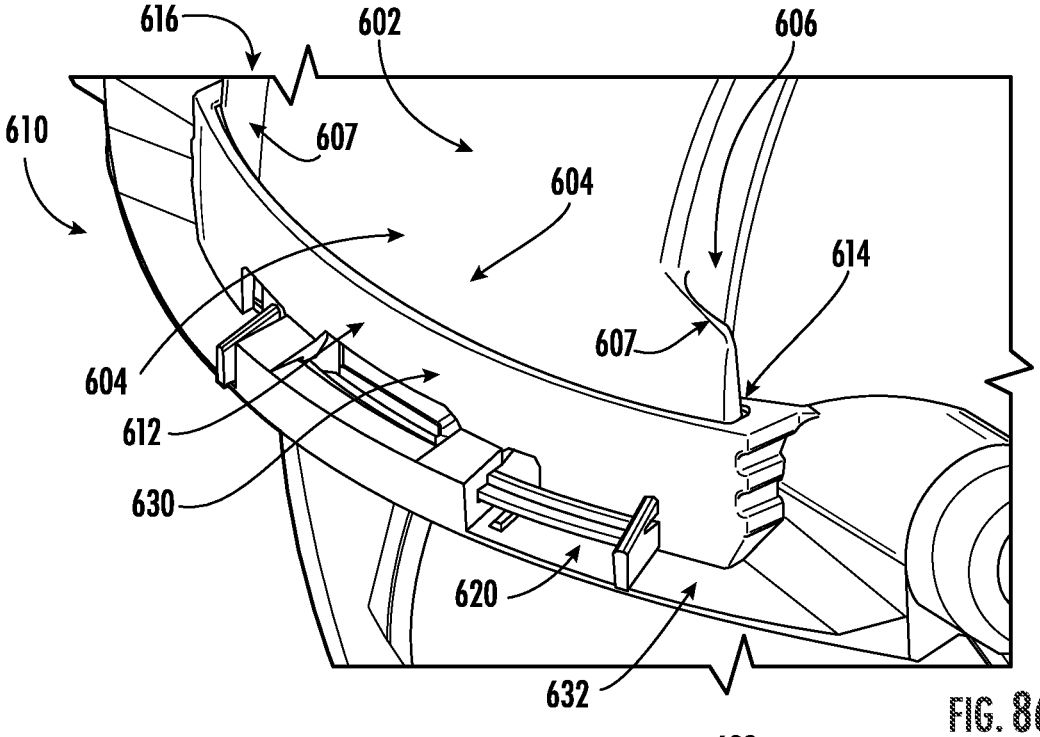
FIG. 86 is a perspective view of a protective system for safety headwear, according to an exemplary embodiment.
Figure 87:
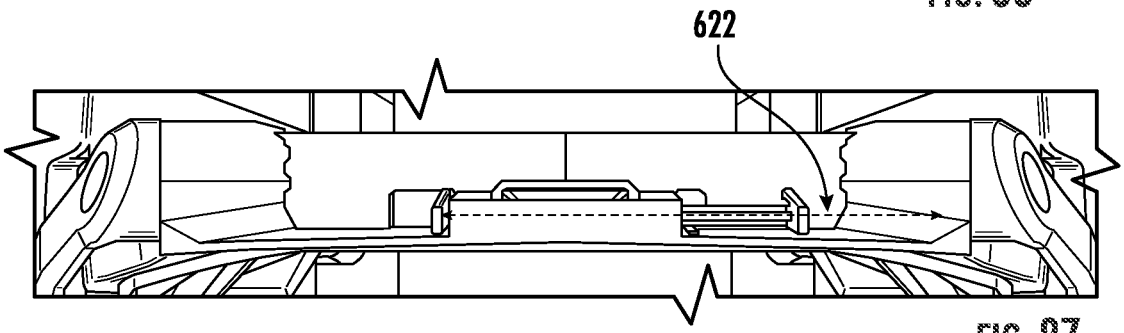
FIG. 87 is a front view of the protective system of FIG. 86, according to an exemplary embodiment.

Face shield 410 includes a mounting bracket 452 that attaches to a hard hat. One or more arms 424 (e.g., two arms 424) are pivotally coupled to mounting bracket 452, and frame 448 is pivotally coupled to the one or more arms 424. Face shield 432 is coupled to frame 448. Slide lock 490 is slideably engaged with mounting bracket 452. Referring to FIG. 81, slide lock 490 includes protrusion 492, which extends inwardly toward the hart hat that mounting bracket 452 is coupled to.

Referring to FIGS. 82-85, various aspects of face shield assembly 510 are shown. Face shield assembly 510 is substantially the same as face shield assembly 410 except for the differences discussed herein. Arms 524 of face shield 510 are less curved compared to arms 424 of face shield 410.

Figure 88:
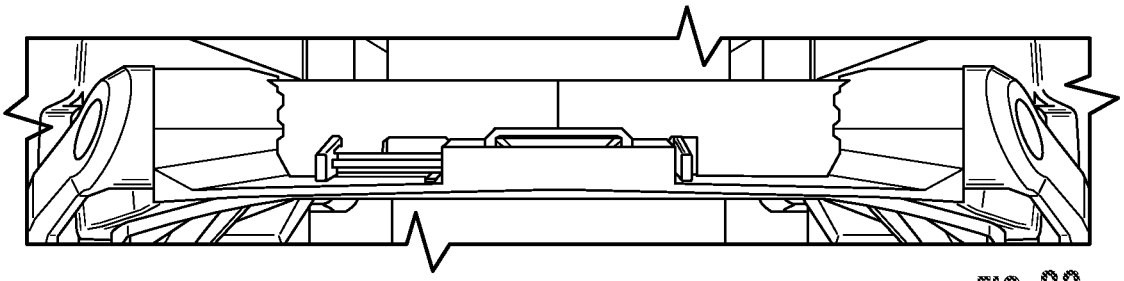
FIG. 88 is a front view of the protective system of FIG. 86, according to an exemplary embodiment.
Figure 89:
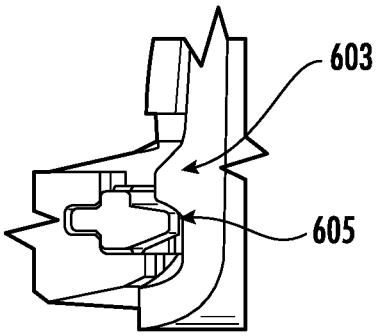
FIG. 89 is a cross-section view of the protective system of FIG. 86, according to an exemplary embodiment.
Figure 90:
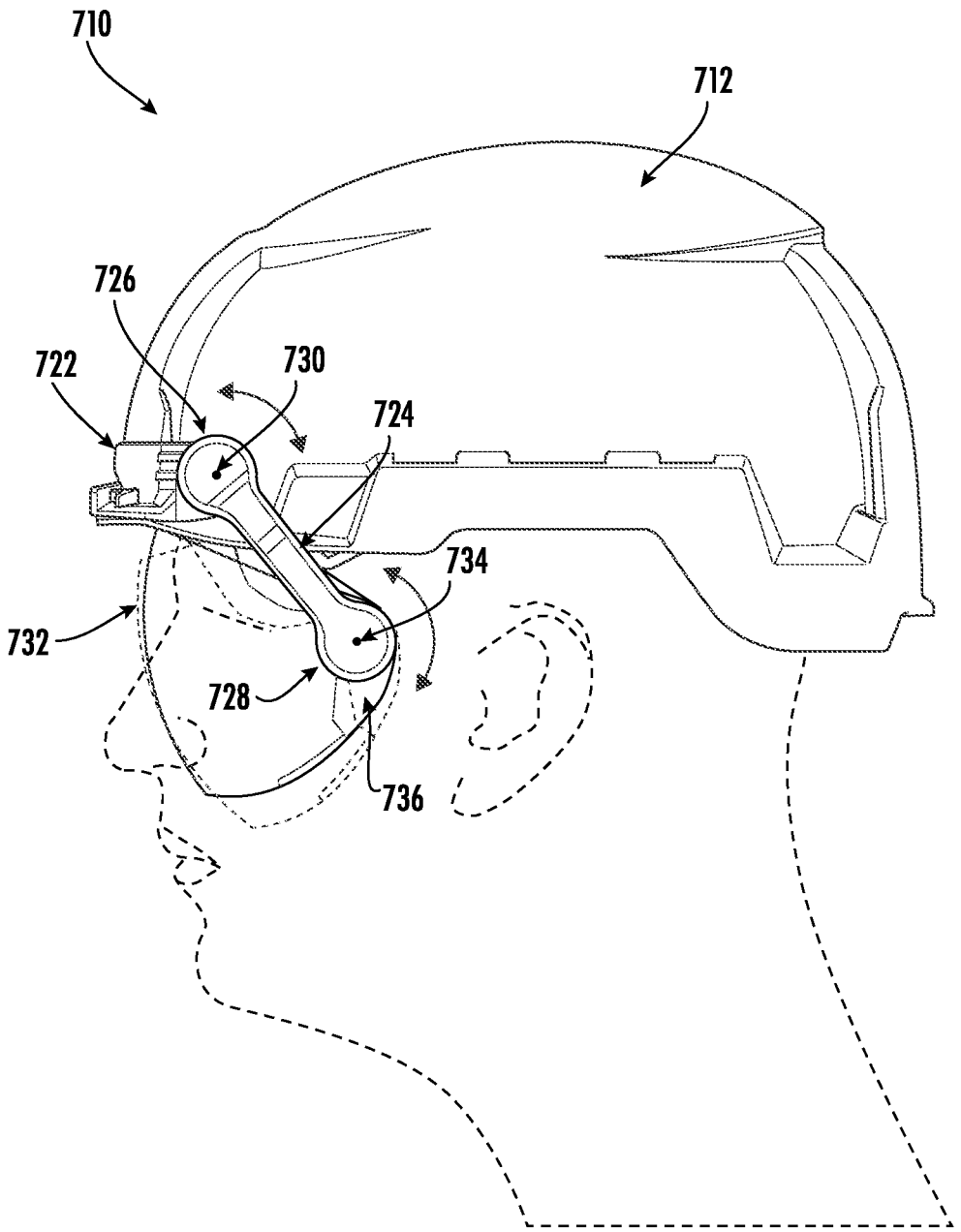
FIG. 90 is a side view of a protective system, according to an exemplary embodiment.

Referring to FIGS. 86-89, various aspects of a protective system for safety headwear are shown. The protective system includes a slide that locks the brim guard to the safety headwear. The slide actuates between a locked position (FIG. 87) and an unlocked position (FIG. 88). The slide interfaces with a protrusion extending from the safety headwear (FIG. 89).

In various embodiments, a hard hat system 601 includes a hard hat, brim guard 610, and a locking mechanism. Brim guard 610 is functionally similar to the brim guard and locking mechanism shown in FIGS. 69-73 except as described herein.

Brim guard 610 is detachably coupled to hard hat 602 such that a front of the brim guard 610 is positioned at a front 604 of the hard hat 602. Brim guard includes a visor 632 that extends radially outward from a center of the hard hat 602.

In various embodiments, a face shield (e.g., face shield 32) is detachably coupled to the brim guard 610. The face shield is moveable between a lowered position and a raised position, such that the face shield is positioned below the brim guard 610 when the face shield is in the lowered position and the face shield is above the brim guard 610 when the face shield is in the raised position.

Locking mechanism 620 is coupled to brim guard 610, such as slideably coupled. Locking mechanism 620 is configured to actuate between a locked position (FIGS. 86-87) and an unlocked position (FIG. 88). Locking mechanism prevents the brim guard 610 from sliding vertically with respect to the hard hat when the locking mechanism 620 is in the locked position. Locking mechanism 620 slides along horizontal axis 622 when transitioning between the locked position and the unlocked position.

Hard hat 602 is similar to hard hat 12 or hard hat 62 with the exception of the differences described. In a specific embodiment, hard hat 602 includes a protrusion 603 that extends forward at front 604 of hard hat 602. The locking mechanism 620 interfaces with lower surface 605 of protrusion 603 when locking mechanism 620 is in the locked position.

In various embodiments, locking mechanism 620 interfaces with protrusion 603 extending from mounting element 606 of hard hat 602. In various embodiments, hard hat 602 includes a mounting element 606 extending from the front 604 of the hard hat 602. Mounting element 606 comprising opposing ridges 607 extending away from each other, and the brim guard 610 is coupled to the hard hat 602 via the mounting element 606. For example, brim guard 610 includes a first lateral wall 614 and a second lateral wall 616, the opposing ridges 607 of the mounting element 606 coupling with the first lateral wall 614 and the second lateral wall 616 of the brim guard 610. In various embodiments, visor 632 extends horizontally from the hard hat. In various embodiments, each of the first lateral wall 614 and the second lateral wall 616 extend upward from the visor 632 and extend circumferentially around a front of the head of the wearer.

Referring to FIGS. 90-99, various aspects of face shield assembly 710 are shown. Face shield assembly 710 is substantially the same as face shield assembly 210, face shield assembly 310, face shield assembly 410, or face shield assembly 510 except for the differences discussed herein. In particular, the arm 724 of face shield 710 has a slightly different shape than the arms of the other face shields (e.g., arm 724 is linear when viewed from the side and concave with respect to the head of the wearer when viewed from the front).

Arm 724 extends from first end 726 to an opposing second end 728. Face shield 732 is coupled to arm 724, such as pivotally coupled so that face shield 732 rotates about first axis 730 with respect to arm 724. In various embodiments face shield 732 is coupled to arm 724 via frame 736, which is rigidly coupled to a portion of the periphery of face shield 732. Arm 724 is coupled to hard hat 712, such as via mounting bracket 722. Mounting bracket 722 is substantially the same as mounting bracket 222, except for the differences discussed herein. In various embodiments arm 724 is pivotally coupled to mounting bracket 722 such that arm 724 rotates about second axis 734 with respect to mounting bracket 222 and/or hard hat 712.

Figure 91:
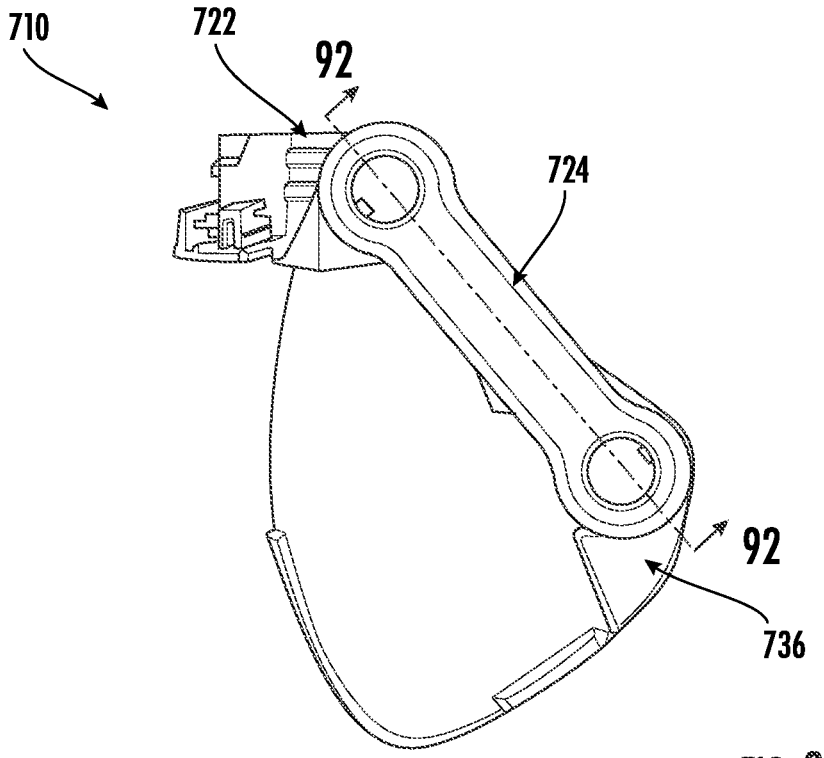
FIG. 91 is a side view of the protective system of FIG. 90, according to an exemplary embodiment.
Figure 92:
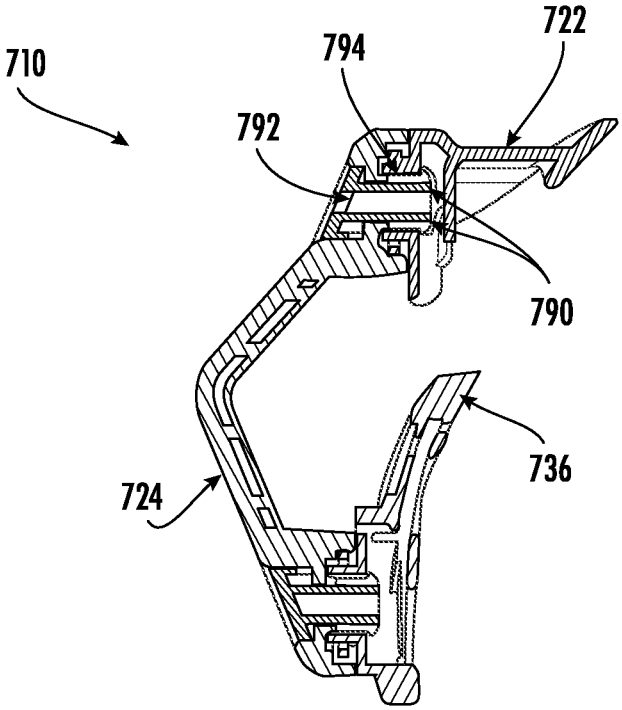
FIG. 92 is a cross-section view of the protective system of FIG. 90 taken along line 92-92 in FIG. 91, according to an exemplary embodiment.
Figure 93:
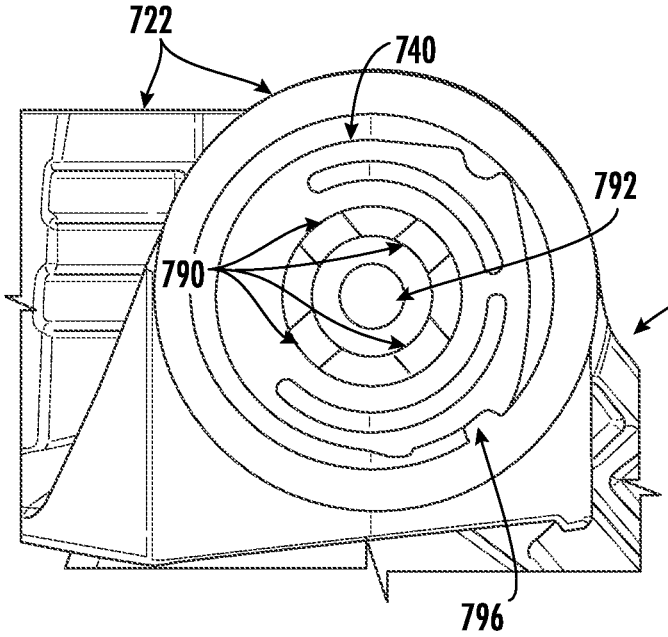
FIG. 93 is a cross-section view of a portion of the protective system of FIG. 90, according to an exemplary embodiment.
Figure 94:
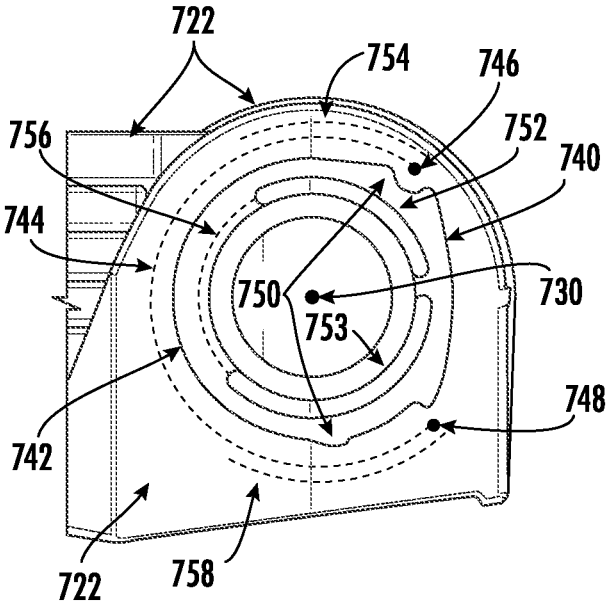
FIG. 94 is a cross-section view of a portion of the protective system of FIG. 90, according to an exemplary embodiment.
Figure 95:
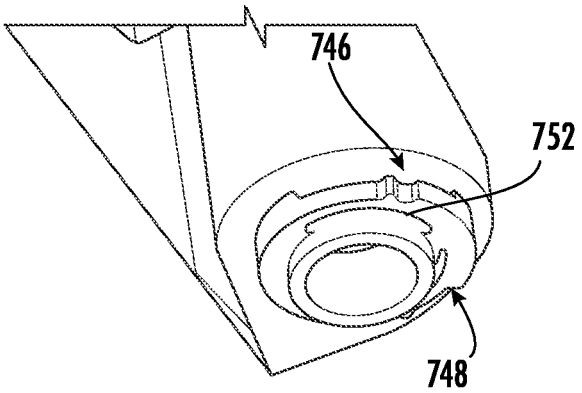
FIG. 95 is a perspective view of a portion of the protective system of FIG. 90, according to an exemplary embodiment.
Figure 96:
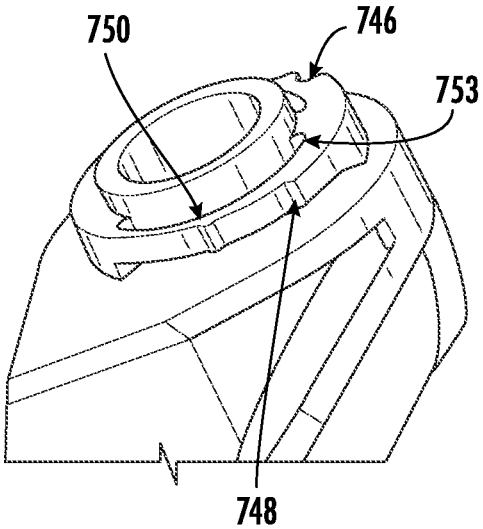
FIG. 96 is a perspective view of a portion of the protective system of FIG. 90, according to an exemplary embodiment.

Referring to FIGS. 91-92, various aspects of arm 724 being coupled to mounting bracket 722 are shown. In various embodiments locking arms 790 extend from arm 724 into aperture 794 of mounting bracket 722. Locking arms 790 are biased outward to remain coupled to aperture 794 by a plug 792, which is inserted between locking arms 790 to bias them radially away from plug 792, thereby securing the engagement between arm 724 and mounting bracket 722.

Referring to FIGS. 93-97, various aspects of arm 724 coupling to mounting bracket 722 are shown. In various embodiments, mounting bracket 722 includes coupling component 740 that couples mounting bracket 722 to arm 724. Arm 724 includes projection 796 that interfaces along outer surface 742 of coupling component 740. The interface between projection 796 of arm 724 and the coupling component 740 facilitates orienting arm 724 in a plurality of configurations with respect to mounting bracket 722. For example, the frictional engagement between projection 796 of arm 724 and the coupling component 740 biases the arm 724 to remain stationary with respect to the mounting bracket 722 once the user has oriented face shield 732 in the desired position (e.g., face shield 732 is fully in front of their face, face shield 732 is partially in front of their face, or face shield 732 is above their face).

The projection 796 of arm 724 interfaces with outer surface 742 along range 744 from first end 746 of range 744 to second end 748 of range 744. Outer surface 742 includes one or more projections 750 that extend radially away from axis 730. Projections 750 are configured to bias the projection of arm 724 towards first end 746 or second end 748 of range 744.

Coupling component 740 defines one or more recesses, shown as first aperture 752 and second aperture 753. In various embodiments, first aperture 752 and/or second aperture 753 extend circumferentially around coupling component with respect to axis 130. Range 744 extends along first unsupported portion 754, support portion 756, and second unsupported portion 758. First unsupported portion 754 is the portion of range 744 radially aligned with first aperture 752 with respect to axis 730, second unsupported portion 758 is the portion of range 744 radially aligned with second aperture 753, and supported portion 756 is circumferentially between first unsupported portion 754 and second unsupported portion 758 with respect to axis 130.

First aperture 752 is configured to permit first unsupported portion 754 of outer surface 742 to deform more than supported portion 756 when the projection 796 of arm 724 is interfacing with first unsupported portion 754. In this way, first unsupported portion 754 and second unsupported portion 758 are configured to function similar to a leaf spring by exerting an outwardly radial force against projection 796 with respect to axis 130. Applicant has observed that permitting first unsupported portion 754 to deform more than supported portion 756 helps protect first unsupported portion 754 from being damaged during use. For example, in use a worker will typically align the projection 796 of arm 724 at second unsupported portion 758 (when the face shield 732 is in front of the face of the worker) or first unsupported portion 754 (when the face shield 732 is above the face of the worker). Thus, those portions of range 744 interface with projection 796 of arm 724 most often. By permitting first unsupported portion 754 and second unsupported portion 758 to more easily deform compared to supported portion 756, the respective outer surface 742 of those portions of range 744 are less likely to be damaged over extended use.

Figure 97:
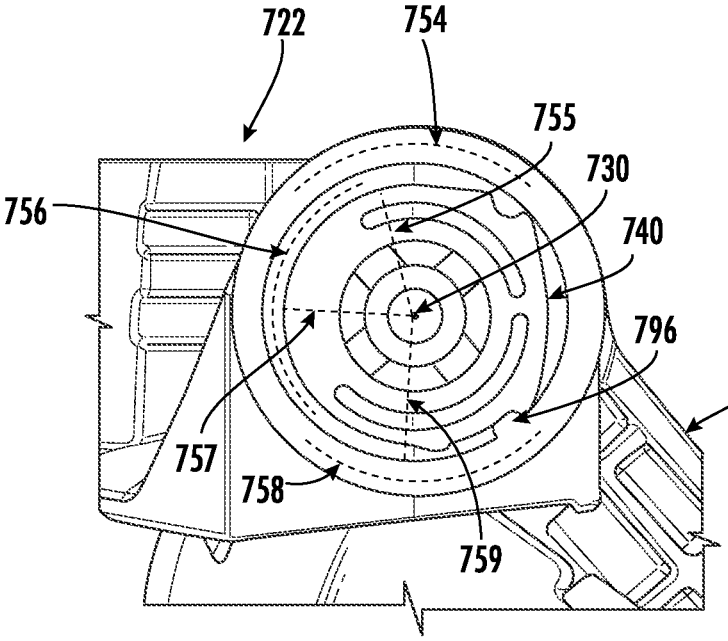
FIG. 97 is a cross-section view of a portion of the protective system of FIG. 90, according to an exemplary embodiment.

Referring to FIG. 97, first unsupported portion 754 defines radius 755 from axis 730, supported portion 756 defines radius 757 from axis 730, and second unsupported portion 758 defines radius 759 from axis 730. In various embodiments, radius 755 and/or radius 759 are longer than radius 757.

In various alternative embodiments, arm 724 includes the coupling component and mounting bracket 722 includes the projection that interfaces with the coupling component of arm 724.

Figure 98:
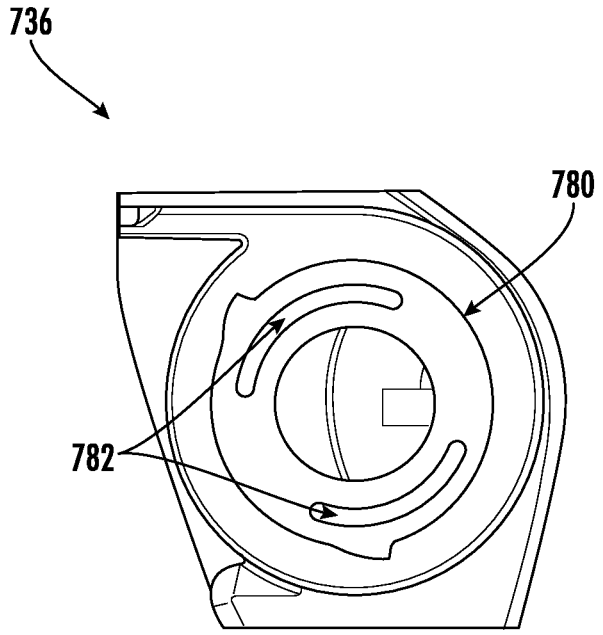
FIG. 98 is a cross-section view of a portion of the protective system of FIG. 90, according to an exemplary embodiment.
Figure 99:
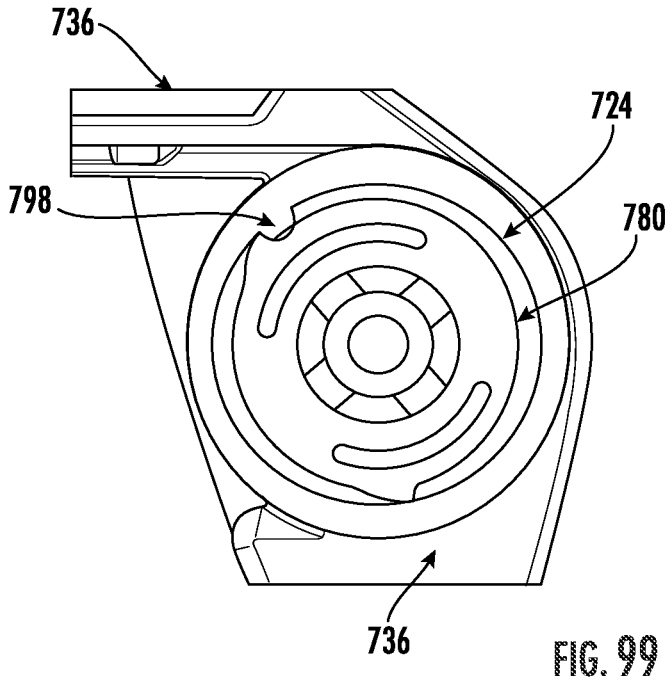
FIG. 99 is a cross-section view of a portion of the protective system of FIG. 90, according to an exemplary embodiment.

Referring to FIGS. 98-99, various aspects of the interface between frame 736 and arm 724 are shown. In particular, frame 736 includes coupling component 780 that pivotally couples frame 736 to arm 724. Coupling component 780 is substantially the same as coupling component 740 except for the differences discussed herein. In particular, coupling component 780 extends from frame 736, and coupling component 780 is configured to interface with a projection 798 extending from arm 724. Similar to coupling component 740, coupling component 780 includes one or more apertures 782 configured to permit coupling component 780 to deform when the projection is interfacing with a portion of coupling component 740 radially aligned with the respective aperture 782.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

What is claimed is:

1. A hard hat system comprising:

a hard hat comprising a shell formed from a rigid material, the shell comprising an external surface and an internal surface that defines a cavity configured to receive a head of a wearer;

a brim guard detachably coupled to the hard hat such that a front of the brim guard is positioned at a front of the hard hat, the brim guard comprising a visor that extends radially outward from a center of the hard hat; and a locking mechanism coupled to the brim guard, the locking mechanism configured to actuate between a locked position and an unlocked position, the locking mechanism preventing the brim guard from sliding vertically with respect to the hard hat when the locking mechanism is in the locked position, the locking mechanism sliding along a horizontal axis when transitioning from the locked position to the unlocked position.

2. The hard hat system of claim 1, further comprising a face shield coupled to the brim guard, the face shield moveable between a lowered position and a raised position, the face shield is positioned below the brim guard when the face shield is in the lowered position and the face shield is above the brim guard when the face shield is in the raised position.

3. The hard hat system of claim 1, the hard hat comprising a protrusion that extends forward from the front of the hard hat, the locking mechanism interfacing with a lower surface of the protrusion when the locking mechanism is in the locked position.

4. The hard hat system of claim 1, the hard hat comprising a mounting element extending from the front of the hard hat, the mounting element comprising opposing ridges extending away from each other, wherein the brim guard is coupled to the hard hat via the mounting element.

5. The hard hat system of claim 4, the brim guard comprising a first lateral wall and a second lateral wall, the opposing ridges of the mounting element coupling with the first lateral wall and the second lateral wall of the brim guard.

6. The hard hat system of claim 5, wherein each of the first lateral wall and the second lateral wall extend upward from the visor.

7. A hard hat system, comprising:

a hard hat comprising a shell formed from a rigid material, the shell comprising an external surface and an internal surface that defines a cavity configured to receive a head of a wearer;

a first arm pivotally coupled to the hard hat, the first arm rotates with respect to the hard hat around a first axis;

a second arm pivotally coupled to the first arm, the second arm rotates with respect to the first arm around a second axis distinct from the first axis; and a face shield pivotally coupled to the second arm, the face shield rotates with respect to the second arm around a third axis, the face shield actuates between an operating position and a stowed position, wherein the face shield is positioned in front of the face of the wearer when the face shield is in the operating position, and wherein the face shield is positioned above a front portion of the external surface of the shell when the face shield is in the stowed position;

wherein the second arm comprises a concave portion with respect to the head of the wearer when the face shield is positioned in the operating position.

8. The hard hat system of claim 7, comprising a mounting bracket detachably coupled to the hard hat, wherein the first arm is pivotally coupled to the mounting bracket such that the first arm is coupled to the hard hat via the mounting bracket.

9. The hard hat system of claim 8, the hard hat comprising ribs that extend circumferentially away from each other, and wherein the mounting bracket is detachably coupled to the ribs.

10. The hard hat system of claim 7, wherein the third axis is distinct from each of the first axis and the second axis.

11. The hard hat system of claim 7, wherein when the face shield is configured in the operating position on the head of the wearer, the face shield covers the eyes of the wearer but does cover not the mouth of the wearer.

12. The hard hat system of claim 7, comprising:

a third arm pivotally coupled to the hard hat, the third arm rotates with respect to the hard hat around the first axis; and a fourth arm pivotally coupled to the third arm, the fourth arm rotates with respect to the third arm around the second axis, the face shield pivotally coupled to the fourth arm.

13. The hard hat system of claim 12, the second arm and the fourth arm each comprise a concave portion with respect to the head of the wearer when the face shield is configured in the operating position.

14. A face shield assembly, comprising:

a mounting bracket configured to be detachably coupled to a hard hat;

a first arm pivotally coupled to the mounting bracket, the first arm rotates with respect to the mounting bracket around a first axis;

a second arm pivotally coupled to the mounting bracket, the second arm rotates with respect to the mounting bracket around the first axis;

a face shield coupled to each of the first arm and the second arm, the face shield actuates between an operating position and a stowed position, wherein the face shield is positioned in front of the face of a wearer when the face shield is in the operating position, and wherein the face shield is positioned above a front portion of the hard hat when the face shield is in the stowed position; and a frame coupled to the face shield and pivotally coupled to each of the first arm and the second arm, the frame pivotally rotates with respect to each of the first arm and the second arm about a second axis, the frame is rigidly coupled to the face shield.

15. The face shield assembly of claim 14, the face shield is mechanically detachably coupled to the face shield.

16. The face shield assembly of claim 14, comprising a locking mechanism coupled to the mounting bracket, the locking mechanism configured to actuate between a locked position and an unlocked position, the locking mechanism preventing the mounting bracket from sliding vertically with respect to the hard hat when the locking mechanism is in the locked position.

17. The face shield assembly of claim 14, the first arm and the second arm each comprise a convex portion with respect to the head of the wearer when the face shield is configured in the operating position.

18. A hard hat system comprising:

a hard hat comprising a shell formed from a rigid material, the shell comprising an external surface and an internal surface that defines a cavity configured to receive a head of a wearer;

a brim guard detachably coupled to the hard hat such that a front of the brim guard is positioned at a front of the hard hat, the brim guard comprising a visor that extends radially outward from a center of the hard hat; and a locking mechanism coupled to the brim guard, the locking mechanism configured to actuate between a locked position and an unlocked position, the locking mechanism preventing the brim guard from sliding vertically with respect to the hard hat when the locking mechanism is in the locked position;

wherein the hard hat comprises a protrusion that extends forward from the front of the hard hat, the locking mechanism interfacing with a lower surface of the protrusion when the locking mechanism is in the locked position.

19. A hard hat system comprising:

a hard hat comprising a shell formed from a rigid material, the shell comprising an external surface and an internal surface that defines a cavity configured to receive a head of a wearer;

a brim guard detachably coupled to the hard hat such that a front of the brim guard is positioned at a front of the hard hat, the brim guard comprising a visor that extends radially outward from a center of the hard hat; and a locking mechanism coupled to the brim guard, the locking mechanism configured to actuate between a locked position and an unlocked position, the locking mechanism preventing the brim guard from sliding vertically with respect to the hard hat when the locking mechanism is in the locked position;

wherein the hard hat comprises a mounting element extending from the front of the hard hat, the mounting element comprising opposing ridges extending away from each other, wherein the brim guard is coupled to the hard hat via the mounting element.

20. A hard hat system, comprising:

a hard hat comprising a shell formed from a rigid material, the shell comprising an external surface and an internal surface that defines a cavity configured to receive a head of a wearer;

a first arm pivotally coupled to the hard hat, the first arm rotates with respect to the hard hat around a first axis;

a second arm pivotally coupled to the first arm, the second arm rotates with respect to the first arm around a second axis distinct from the first axis; and a face shield pivotally coupled to the second arm, the face shield rotates with respect to the second arm around a third axis, the face shield actuates between an operating position and a stowed position, wherein the face shield is positioned in front of the face of the wearer when the face shield is in the operating position, and wherein the face shield is positioned above a front portion of the external surface of the shell when the face shield is in the stowed position;

wherein the third axis is distinct from each of the first axis and the second axis.

21. The hard hat system of claim 20, wherein, when the face shield is positioned in the operating position on the head of the wearer, the face shield covers the eyes of the wearer but does cover not the mouth of the wearer.

22. A hard hat system, comprising:

a hard hat comprising a shell formed from a rigid material, the shell comprising an external surface and an internal surface that defines a cavity configured to receive a head of a wearer;

a first arm pivotally coupled to the hard hat, the first arm rotates with respect to the hard hat around a first axis;

a second arm pivotally coupled to the first arm, the second arm rotates with respect to the first arm around a second axis distinct from the first axis;

a face shield pivotally coupled to the second arm, the face shield rotates with respect to the second arm around a third axis, the face shield actuates between an operating position and a stowed position, wherein the face shield is positioned in front of the face of the wearer when the face shield is in the operating position, and wherein the face shield is positioned above a front portion of the external surface of the shell when the face shield is in the stowed position;

a third arm pivotally coupled to the hard hat, the third arm rotates with respect to the hard hat around the first axis; and a fourth arm pivotally coupled to the third arm, the fourth arm rotates with respect to the third arm around the second axis, the face shield pivotally coupled to the fourth arm.

23. A face shield assembly, comprising:

a mounting bracket configured to be detachably coupled to a hard hat;

a first arm pivotally coupled to the mounting bracket, the first arm rotates with respect to the mounting bracket around a first axis;

a second arm pivotally coupled to the mounting bracket, the second arm rotates with respect to the mounting bracket around the first axis;

a face shield coupled to each of the first arm and the second arm, the face shield actuates between an operating position and a stowed position, wherein the face shield is positioned in front of the face of a wearer when the face shield is in the operating position, and wherein the face shield is positioned above a front portion of the hard hat when the face shield is in the stowed position; and a locking mechanism coupled to the mounting bracket, the locking mechanism configured to actuate between a locked position and an unlocked position, the locking mechanism preventing the mounting bracket from sliding vertically with respect to the hard hat when the locking mechanism is in the locked position.

24. A face shield assembly, comprising:

a mounting bracket configured to be detachably coupled to a hard hat;

a first arm pivotally coupled to the mounting bracket, the first arm rotates with respect to the mounting bracket around a first axis;

a second arm pivotally coupled to the mounting bracket, the second arm rotates with respect to the mounting bracket around the first axis; and a face shield coupled to each of the first arm and the second arm, the face shield actuates between an operating position and a stowed position, wherein the face shield is positioned in front of the face of a wearer when the face shield is in the operating position, and wherein the face shield is positioned above a front portion of the hard hat when the face shield is in the stowed position;

wherein the first arm and the second arm each comprise a convex portion with respect to a head of the wearer when the face shield is configured in the operating position.

* * * * *